US008287115B2

(12) United States Patent
Shinkawa

(10) Patent No.: US 8,287,115 B2
(45) Date of Patent: Oct. 16, 2012

(54) RECORDING APPARATUS AND METHOD FOR HEATING RECORDING MEDIUM

(75) Inventor: Osamu Shinkawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 578 days.

(21) Appl. No.: 12/340,974

(22) Filed: Dec. 22, 2008

(65) Prior Publication Data

US 2009/0160925 A1 Jun. 25, 2009

(30) Foreign Application Priority Data

Dec. 25, 2007 (JP) ..... 2007-331599

(51) Int. Cl.
*B41J 29/38* (2006.01)
*B41J 2/01* (2006.01)
*B41J 29/393* (2006.01)

(52) U.S. Cl. ..... 347/102; 347/17; 347/19

(58) Field of Classification Search ..... None
See application file for complete search history.

(56) References Cited

U.S. PATENT DOCUMENTS 5,937,761 A 8/1999 Buschmann et al.
6,248,804 B1 * 6/2001 Lutz ..... 523/160
6,425,663 B1 * 7/2002 Eastlund et al. ..... 347/102
6,508,550 B1 * 1/2003 Eastlund et al. ..... 347/102
6,508,552 B1 * 1/2003 Steinfield et al. ..... 347/102
6,686,573 B2 * 2/2004 Behnke et al. ..... 219/679
7,298,994 B2 * 11/2007 Morgenweck et al. ..... 399/251
7,913,417 B2 * 3/2011 Patka et al. ..... 34/259
2003/0151734 A1 * 8/2003 Donahue et al. ..... 356/71
2008/0117273 A1 * 5/2008 Yamashita et al. ..... 347/96

FOREIGN PATENT DOCUMENTS

JP 11-138756 A 5/1999
JP 2001-301131 A 10/2001

* cited by examiner

*Primary Examiner* — Stephen Meier
*Assistant Examiner* — Leonard S Liang
(74) *Attorney, Agent, or Firm* — Maschoff Gilmore & Israelsen

(57) ABSTRACT

A recording apparatus is provided which includes recording means for ejecting liquid so that the liquid is recorded on a recording medium; transporting means for transporting the recording means relative to the recording medium; microwave irradiation means for irradiating microwaves to the recording medium; microwave reception means for receiving the microwaves reflected from the recording medium; and microwave irradiation control means for determining a dryness level of the recording medium based on a reception level of the microwave reception means and controlling an irradiation dose or an irradiation intensity of the microwaves irradiated by the microwave irradiation means in accordance with the dryness level.

4 Claims, 11 Drawing Sheets

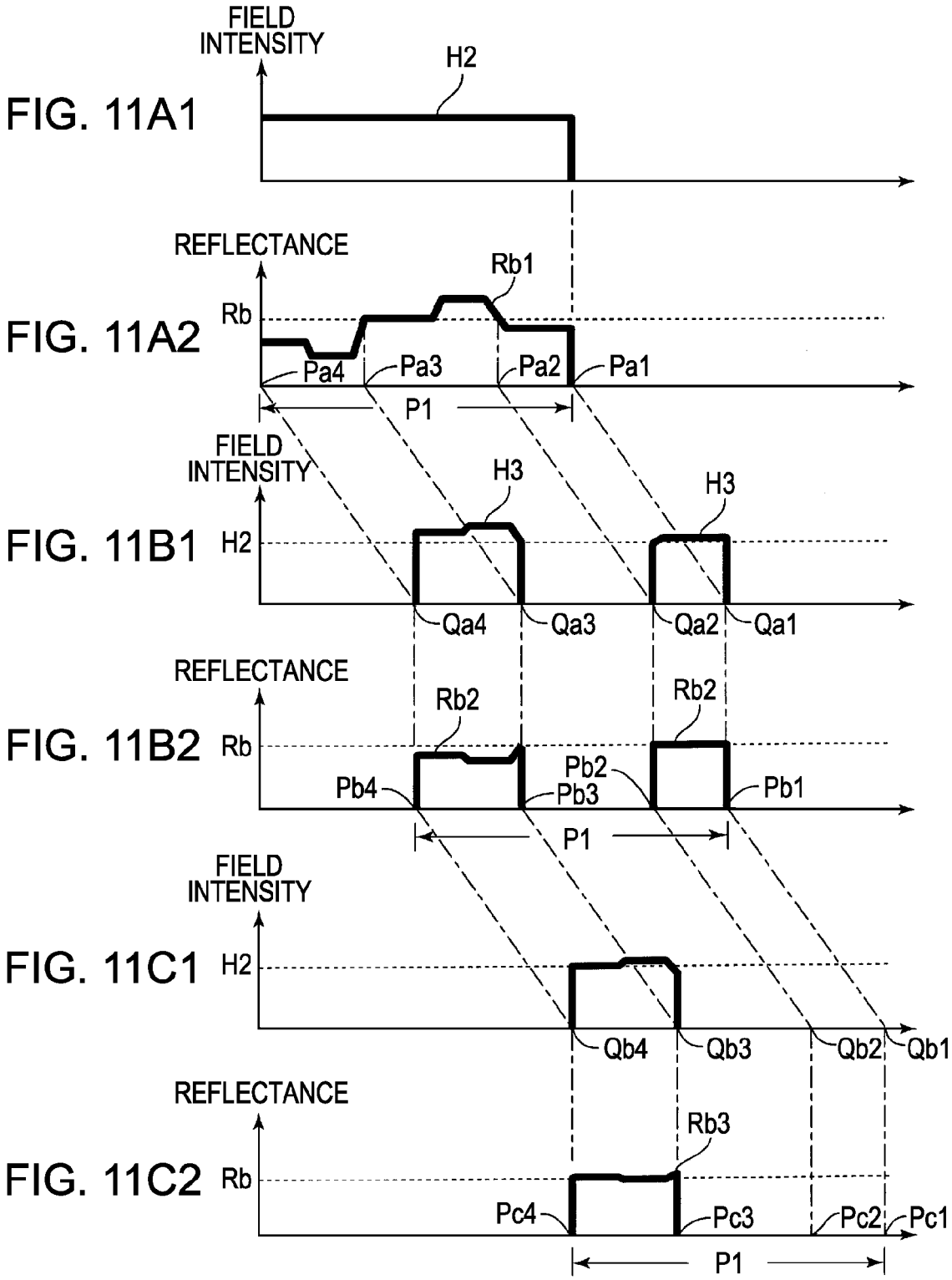
FIG. 11A1
FIELD INTENSITY
H2
FIG. 11A2
REFLECTANCE
Rb1
Rb
Pa4
Pa3
Pa2
Pa1
P1
FIG. 11B1
FIELD INTENSITY
H3
H3
H2
Qa4
Qa3
Qa2
Qa1
FIG. 11B2
REFLECTANCE
Rb2
Rb2
Rb
Pb4
Pb3
Pb2
Pb1
P1
FIG. 11C1
FIELD INTENSITY
H2
Qb4
Qb3
Qb2
Qb1
FIG. 11C2
REFLECTANCE
Rb3
Rb
Pc4
Pc3
Pc2
Pc1
P1

RECORDING APPARATUS AND METHOD FOR HEATING RECORDING MEDIUM

BACKGROUND

1. Technical Field

The present invention relates to a recording apparatus and method for heating a recording medium.

2. Related Art

Ink jet printers perform recording on a recording sheet by means of aqueous ink. In such a case, when a user touches the ink with the user's fingers or the like before the ink is sufficiently dried, a recorded portion may be stained, by rubbing, with the ink, and when another recording sheet is stacked on the recorded recording sheet, the non-dried ink may undesirably adhere on the recording sheet. Particularly, in the case of a line head type ink jet printer, recording is performed on one sheet of recording sheet within about one second, for example. Therefore, when a recording sheet discharged with images recorded thereon is stacked in the stacker, a subsequent recording sheet may be stacked on the recording sheet before the ink is sufficiently dried. Thus, the ink of the lower recording sheet may undesirably adhere on the recording sheet stacked thereon.

To resolve such a problem, JP-A-2006-010889, for example, discloses means for irradiating microwaves to a recording sheet having ink images recorded thereon to heat the ink, thus decreasing the ink drying time.

However, in the case of the means disclosed in JP-A-2006-010889, an irradiation dose or an irradiation intensity of the microwaves is constant regardless of a dryness level of the applied ink. Therefore, when the amount of applied ink is small and the moisture level is low relative to the fixed irradiation dose or intensity of the irradiation dose, the recording sheet may be excessively heated and thus undesirably catch fire or be deteriorated with intense heat. To the contrary, when the amount of applied ink is small but the moisture level is high, the recording sheet might not be sufficiently dried.

SUMMARY

An advantage of some aspects of the invention is that it provides a recording apparatus and method capable of drying a recording sheet to an appropriate dryness level regardless of a dryness level (moisture level) of the recording sheet.

According to an aspect of the invention, there is provided a recording apparatus which includes recording means for ejecting liquid so that the liquid is recorded on a recording medium; transporting means for transporting the recording means relative to the recording medium; microwave irradiation means for irradiating microwaves to the recording medium; microwave reception means for receiving the microwaves reflected from the recording medium; and microwave irradiation control means for determining a dryness level of the recording medium based on a reception level of the microwave reception means and controlling an irradiation dose or an irradiation intensity of the microwaves irradiated by the microwave irradiation means in accordance with the dryness level.

Owing to such a configuration of the recording apparatus, it is possible to dry the recording medium to an appropriate dryness level regardless of a dryness level of the recording medium.

In the recording apparatus, the microwave irradiation means irradiates the microwaves to a plurality of areas of the recording medium, the microwave reception means receives the microwaves reflected from the plurality of areas, and the microwave irradiation control means determines the dryness level of the recording medium at the plurality of areas based on the reception level of the microwave reception means and controls the irradiation dose or the irradiation intensity of the microwaves irradiated by the microwave irradiation means. Owing to such a configuration of the recording apparatus, the respective areas of the recording medium can be dried to the appropriate dryness level depending on the different dryness levels of the respective areas.

In the recording apparatus, the microwave irradiation control means controls the irradiation dose or the irradiation intensity of the microwaves with respect to a first area of the plurality of areas based on the dryness level of the recording medium at a second area located upstream the first area in the direction for transporting the recording means relative to the recording medium. Owing to such a configuration of the recording apparatus, the dryness level of the recording medium can be gradually changed to approach the predetermined dryness level when it passes through the respective areas. Therefore, it is possible to suppress the drying stress generated when the recording medium is abruptly dried, thus preventing deformation such as rippling or curling of the recording medium. Moreover, by irradiating the irradiating portion with the microwaves of the irradiation dose necessary for changing the dryness level of the irradiating portion to the predetermined dryness level in several times, it is possible to heat the irradiating portion at high temperature at which the irradiating portion is prevented from catching fire or being deteriorated. Furthermore, since the drying can be performed while continuing the transport of the recording medium P, it is possible to shorten the time in which the recording medium passes through the heating portion. Particularly, when a line recording head is used as the recording head, the recording operation of the recording portion can be performed in a short period of time, and the transport speed of the recording medium can be increased. Therefore, by allowing the heating portion to heat the recording medium without stopping the transport of the recording medium, it is possible to increase an overall processing speed of the printer including a recording speed and a heating speed.

BRIEF DESCRIPTION OF THE DRAWINGS

The invention will be described with reference to the accompanying drawings, wherein like numbers reference like elements.

FIGS. 11A1 to 11C2 are views showing the relationship between an irradiation dose and a reflectance of microwaves according to the third embodiment.

DESCRIPTION OF EXEMPLARY EMBODIMENTS

First Embodiment

An ink jet printer 100 (hereinafter, simply referred to as a "printer") as a recording apparatus according to a first embodiment of the present invention will be described with reference to FIGS. 1 to 6. Moreover, a recording medium heating device will be described in connection with a construction of the printer 100, and a recording method will be described in connection with an operation of the printer 100.

Figure 1:
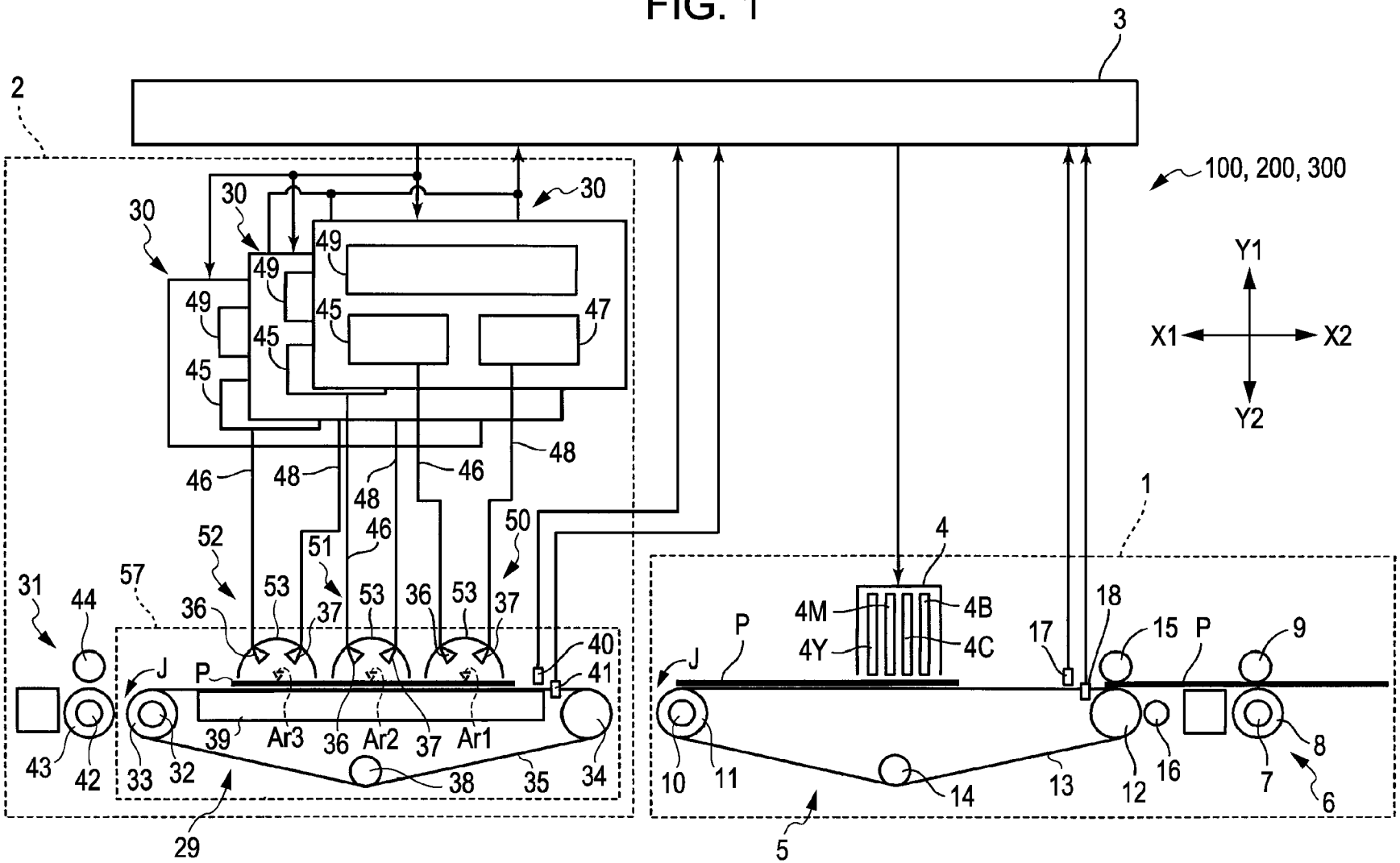
FIG. 1 is a schematic view illustrating an overall structure of a printer according to embodiments of the present invention.
Figure 2:
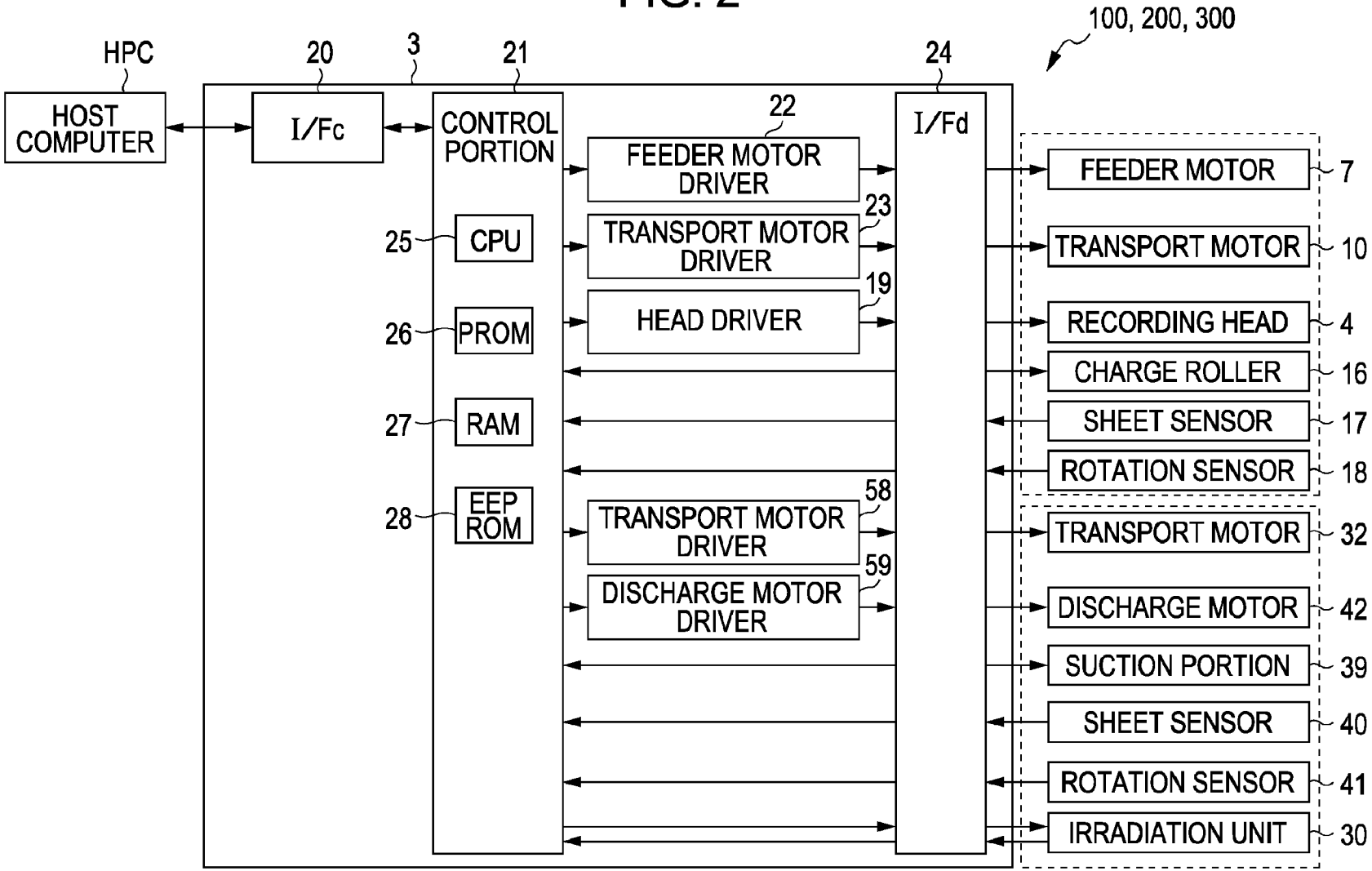
FIG. 2 is a block diagram illustrating an electrical structure of the printer shown in FIG. 1.

FIG. 1 is a schematic view illustrating an overall structure of the printer 100. In the following description, the direction of an arrow X1 in the drawing figures is regarded as a forward direction (front side), the direction of an arrow X2 as a backward direction (rear side), the direction of an arrow Y1 as an upward direction (upper side) and the direction of an arrow Y2 as a downward direction (lower side), and the right-hand side in the rear-to-front direction is regarded as a rightward direction (right side) the left-hand side in the rear-to-front direction as a leftward direction (left side). FIG. 2 is a circuit block diagram illustrating an electrical structure of the printer 100.

Overall Structure

The printer 100 includes a recording portion 1 that performs recording on a recording sheet P as a recording medium, a heating portion 2 constituting a recording medium heating device, which heats the recording sheet P discharged from the recording portion 1, and a system control portion 3 that controls the recording portion 1 and the heating portion 2.

In the recording portion 1, recording is performed on the recording sheet P by ejecting ink to the recording sheet P. Therefore, the recording sheet P discharged from the recording portion 1 is wet with moisture being the solvent of ink. The wet recording sheet P is transported to the heating portion 2, and microwaves are irradiated to the recording sheet P in the heating portion 2. By the irradiation of the microwaves, the moisture of applied ink is heated, thus accelerating the evaporation of the moisture, and the recording sheet P can be dried in a short time. As will be described later, the heating portion 2 is configured to control an irradiation dose (or an irradiation intensity) of the microwaves in accordance with a moisture level, i.e., a dryness level, of the recording sheet P. That is, the heating portion 2 is configured to be capable of preventing the recording sheet P from being excessively heated by the heating portion 2 to catch fire or be deteriorated with intense heat, or from being insufficiently dried.

Structure of Recording Portion 1

First, a description of the structure of the recording portion 1 will be provided hereinbelow. The recording portion 1 includes a recording head 4 that ejects ink to the recording sheet P, a sheet transport portion 5 that transports the recording sheet P below the recording head 4 in the rear-to-front direction thereof, and a sheet feeding portion 6 that feeds the recording sheet P toward the sheet transport portion 5.

Structure of Sheet Feeding Portion 6

The sheet feeding portion 6 includes a sheet feed motor 7, a sheet feed roller 8 that is driven by the sheet feed motor 7, and a driven roller 9 that is paired with the sheet feed roller 8. The sheet feed roller 8 and the driven roller 9 have a length slightly longer than a transverse width of the recording sheet P. The driven roller 9 presses the recording sheet P against the sheet feed roller 8 in a state where the recording sheet P is inserted between the sheet feed roller 8 and the driven roller 9. Therefore, the recording sheet P is transported to the sheet transport portion 5 in response to rotation of the sheet feed roller 8. The driven roller 9 rotates with the movement of the recording sheet P.

Structure of Sheet Transport Portion 5

The sheet transport portion 5 includes a sheet transport motor 10, a sheet transport roller 11, a driven roller 12, and a sheet transport belt 13. The sheet transport roller 11 is disposed on the front side of the recording head 4 and is driven by the sheet transport motor 10. The driven roller 12 is disposed on the rear side of the sheet transport roller 11 with the recording head 4 disposed between them. Moreover, the endless sheet transport belt 13 is stretched between the sheet transport roller 11 and the driven roller 12.

Between and below the sheet transport roller 11 and the driven roller 12, a tension roller 14 is provided for applying tension to the sheet transport belt 13. The sheet transport belt 13 has a length slightly longer than the transverse width of the recording sheet P. A sheet pressing roller 15 is disposed above the driven roller 12.

The recording sheet P fed from the sheet feeding portion 6 to the sheet transport portion 5 is transported in such a way that it squeezes between the sheet pressing roller 15 and the sheet transport belt 13. The sheet pressing roller 15 applies a pressing force toward the sheet transport belt 13, which acts on the recording sheet P. The sheet transport roller 11 rotates counterclockwise (in the direction indicated by an arrow J in FIG. 1), and in response to the rotation, an upper portion (on which the recording sheet P is placed) of the sheet transport belt 13 being stretched between the sheet transport roller 11 and the driven roller 12 is moved in the rear-to-front direction. Therefore, the recording sheet P transported from the sheet feeding portion 6 to between the sheet transport belt 13 and the sheet pressing roller 15 is transported in the rear-to-front direction in a state of being placed on the sheet transport belt 13.

The sheet transport belt 13 is formed of material that is easily electrostatically charged, such as PET. Moreover, on the rear side of the driven roller 12, a charge roller 16 is provided to be adjacent to the sheet transport belt 13, for electrostatically charging the sheet transport belt 13, and thus, the sheet transport belt 13 is electrostatically charged by the charge roller 16. When the sheet transport belt 13 is electrostatically charged by the charge roller 16, the recording sheet P transported on the sheet transport belt 13 is electrostatically caused to adhere to the sheet transport belt 13. Moreover, as described above, since the recording sheet P is pressed toward the sheet transport belt 13 by the sheet pressing roller 15, the recording sheet P can be certainly electrostatically adhered to the sheet transport belt 13.

Structure of Sheet Detection Sensor 17 and Rotation Detection Sensor 18

On the front side of the driven roller 12, a sheet detection sensor 17 capable of detecting presence of the recording sheet P on the sheet transport belt 13 and a rotation detection sensor 18 capable of detecting the rotation of the sheet transport belt 13 are provided.

The sheet detection sensor 17 is provided with a non-illustrated light emitting portion and a non-illustrated light receiving portion and is configured to detect the presence of the recording sheet P on the sheet transport belt 13, e.g., by means of a difference in reflected light intensity between a case where the recording sheet P of, for example, white color is present on the sheet transport belt 13 of, for example, black color and a case where the recording sheet P is not present on the sheet transport belt 13. The rotation detection sensor 18 constitutes an optical encoder together with a non-illustrated linear scale that is provided at a left end of the sheet transport belt 13 so as to extend over the entire circumference of the sheet transport belt 13. Therefore, it is possible to measure a transport amount of the recording sheet P by the sheet transport portion 5 based on the detection results by the sheet detection sensor 17 and the rotation detection sensor 18.

Structure of Recording Head 4

The recording head 4 is a line recording head with a recording width capable of simultaneously ejecting ink over the entire transverse width of the recording sheet P, in which recording heads 4B, 4C, 4M, and 4Y corresponding to ink colors of black, cyan, magenta, and yellow are arranged in the front-rear direction. The recording head 4 is configured to receive a driving signal from a head driver 19 to eject ink of respective ink colors at predetermined positions on the recording sheet P being transported forward by the sheet transport belt 13, so that predetermined images, characters, and the like are recorded on the recording sheet P.

Operation of Recording Portion 1

Subsequently, a description of the operation of the recording portion 1 will be provided with reference to FIG. 2. The system control portion 3 of the printer 100 is provided with an interface portion (I/Fc) 20 that receives image forming data or the like input from a host computer HPC, a control portion 21, a sheet feed motor driver 22 that controls the driving of the sheet feed motor 7, a sheet transport motor driver 23 that controls the driving of the sheet transport motor 10, and a recording head driver 19 that controls the driving of the recording head 4. The system control portion 3 is further provided with an interface portion (I/Fd) 24 that outputs a control signal from the system control portion 3 to the recording portion 1 or receives signals from the sheet detection sensor 17 and the rotation detection sensor 18.

The control portion 21 is provided with a CPU (Central Processing Unit) 25 that controls various operations of the printer 100 based on the image forming data and the like delivered from the host computer HPC, including the ejection of the recording head 4, the driving of the sheet feed motor 7 or the sheet transport motor 10, and the charging of the charge roller 16, a PROM (Programmable Read-Only Memory) 26 that stores processing program related to the various operations of the printer 100, a RAM (Random Access Memory) 27 which is a work memory, an EEPROM (Electrically Erasable Programmable Read-Only Memory) 28 that stores the image forming data and the like input via the interface portion (I/Fc) 20 from the host computer HPC.

The control portion 21 controls a rotation speed of the sheet feed motor 7 and the sheet transport motor 10 based on the image forming data and the detection signals of the sheet detection sensor 17 and the rotation detection sensor 18 and controls the driving of the recording head 4 so that ink of a predetermined color is ejected at a predetermined position on the recording sheet P, thereby recording images or the like on the recording sheet P. The recorded recording sheet P is transported toward a later-described heating portion 2 by the sheet transport portion 5.

Structure of Heating Portion 2

Next, a description of the structure of the heating portion 2 will be provided. The heating portion 2 includes a sheet transport portion 29 as transporting means for transporting the recording sheet P in the rear-to-front direction, a microwave irradiation unit 30 that irradiates microwaves to the recording sheet P, and a sheet discharge portion 31.

Structure of Sheet Transport Portion 29

The sheet transport portion 29 includes a sheet transport motor 32, a sheet transport roller 33, a driven roller 34, and a sheet transport belt 35. The sheet transport roller 33 is disposed on the front side of a microwave irradiation portion 36 and a microwave incident portion 37, which are provided to the microwave irradiation unit 30, and is driven by the sheet transport motor 32. The driven roller 34 is disposed on the rear side of the sheet transport roller 33 with the microwave irradiation portion 36 and the microwave incident portion 37 disposed between them. Moreover, the endless sheet transport belt 35 is stretched between the sheet transport roller 33 and the driven roller 34.

Between and below the sheet transport roller 33 and the driven roller 34, a tension roller 38 is provided for applying tension to the sheet transport belt 35. The sheet transport belt 35 has a length slightly longer than the transverse width of the recording sheet P so that it makes contact with the entire transverse width of the recording sheet P. The sheet transport roller 33 rotates counterclockwise (in the direction indicated by the arrow J in FIG. 1), and in response to the rotation, an upper portion (on which the recording sheet P is placed) of the sheet transport belt 35 being stretched between the sheet transport roller 33 and the driven roller 34 is moved in the rear-to-front direction. Therefore, the recording sheet P transported from the sheet transport portion 5 to the heating portion 2 is transported in the rear-to-front direction in a state of being placed on the sheet transport belt 35 of the sheet transport portion 29.

On an inner circumferential side of the sheet transport belt 35: specifically, below an upper portion of the sheet transport belt 35 being stretched between the sheet transport roller 33 and the driven roller 34, a suction portion 39 is provided. The suction portion 39 is disposed so that non-illustrated suction holes oppose the sheet transport belt 35. Moreover, a plurality of micropores (e.g., 1 mm in diameter) is formed at predetermined intervals in matrix form on the sheet transport belt 35. Owing to such a configuration, when the suction portion 39 performs its suction operation, an attractive force can be applied to an outer circumferential surface of the sheet transport belt 35 through the micropores formed in the sheet transport belt 35. Therefore, the recording sheet P transported on the sheet transport belt 35 can be attracted toward the sheet transport belt 35 by the attractive force of the suction portion 39.

The suction holes of the suction portion 39 are formed over the approximately entire areas thereof between the sheet transport roller 33 and the driven roller 34. Owing to such a configuration, when the recording sheet P is transported on the sheet transport belt 35, it can be transported in a flat state in conformity with the flatness of the sheet transport belt 35 while being prevented from floating upward by a wind pressure during the transport or from rippling or curving (curling) itself.

On the front side of the driven roller 34, a sheet detection sensor 40 capable of detecting presence of the recording sheet P on the sheet transport belt 35 and a rotation detection sensor 41 capable of detecting the rotation of the sheet transport belt 35 are provided.

Structure of Sheet Detection Sensor 40 and Rotation Detection Sensor 41

The sheet detection sensor 40 has the same structure as the sheet detection sensor 17. Specifically, the sheet detection sensor 40 is provided with a non-illustrated light emitting portion and a non-illustrated light receiving portion and is configured to detect the presence of the recording sheet P on the sheet transport belt 35 by means of a difference in reflected light intensity between a case where the recording sheet P is present on the sheet transport belt 35 and a case where the recording sheet P is not present on the sheet transport belt 35. The rotation detection sensor 41 has the same structure as the rotation detection sensor 18. Specifically, the rotation detection sensor 41 is provided with a non-illustrated linear scale that is provided at a left end of the sheet transport belt 35 so as to extend over the entire circumference of the sheet transport belt 35, and is configured to measure an amount of rotation of the sheet transport belt 35 by counting the number of times light is blocked or passed in response to movement of the linear scale.

Therefore, by causing the sheet detection sensor 40 to detect the leading end of the recording sheet P transported on the sheet transport belt 35, and after the leading end has been detected, by allowing the rotation detection sensor 41 to detect the rotation amount of the sheet transport belt 35, the transport amount of the recording sheet P can be measured.

The recording sheet P is transported from the sheet transport portion 29 to the sheet discharge portion 31 and is then discharged to a non-illustrated stacker that is disposed on the front side of the sheet discharge portion 31. The sheet discharge portion 31 includes a discharge motor 42, a discharge roller 43 that is driven by the discharge motor 42, and a driven roller 44 that is paired with the discharge roller 43. The recording sheet P conveyed from the sheet transport portion 29 by the discharge roller 43 and the driven roller 44 is supplied to the stacker (not shown).

Structure of Microwave Irradiation Unit 30

In the heating portion 2, a plurality of microwave irradiation units 30 is provided, and a microwave oscillation circuit 45 and a microwave irradiation portion 36, both of which serve as microwave irradiation means for irradiating microwaves, a waveguide 46 that couples the microwave oscillation circuit 45 and the microwave irradiation portion 36 with each other, a microwave incident portion 37 and a microwave reception circuit 47, both of which serve as microwave reception means for receiving microwaves, a waveguide 48 that couples the microwave incident portion 37 and the microwave reception circuit 47 with each other, and a microwave control circuit 49 are provided each microwave irradiation unit 30.

Figure 3:
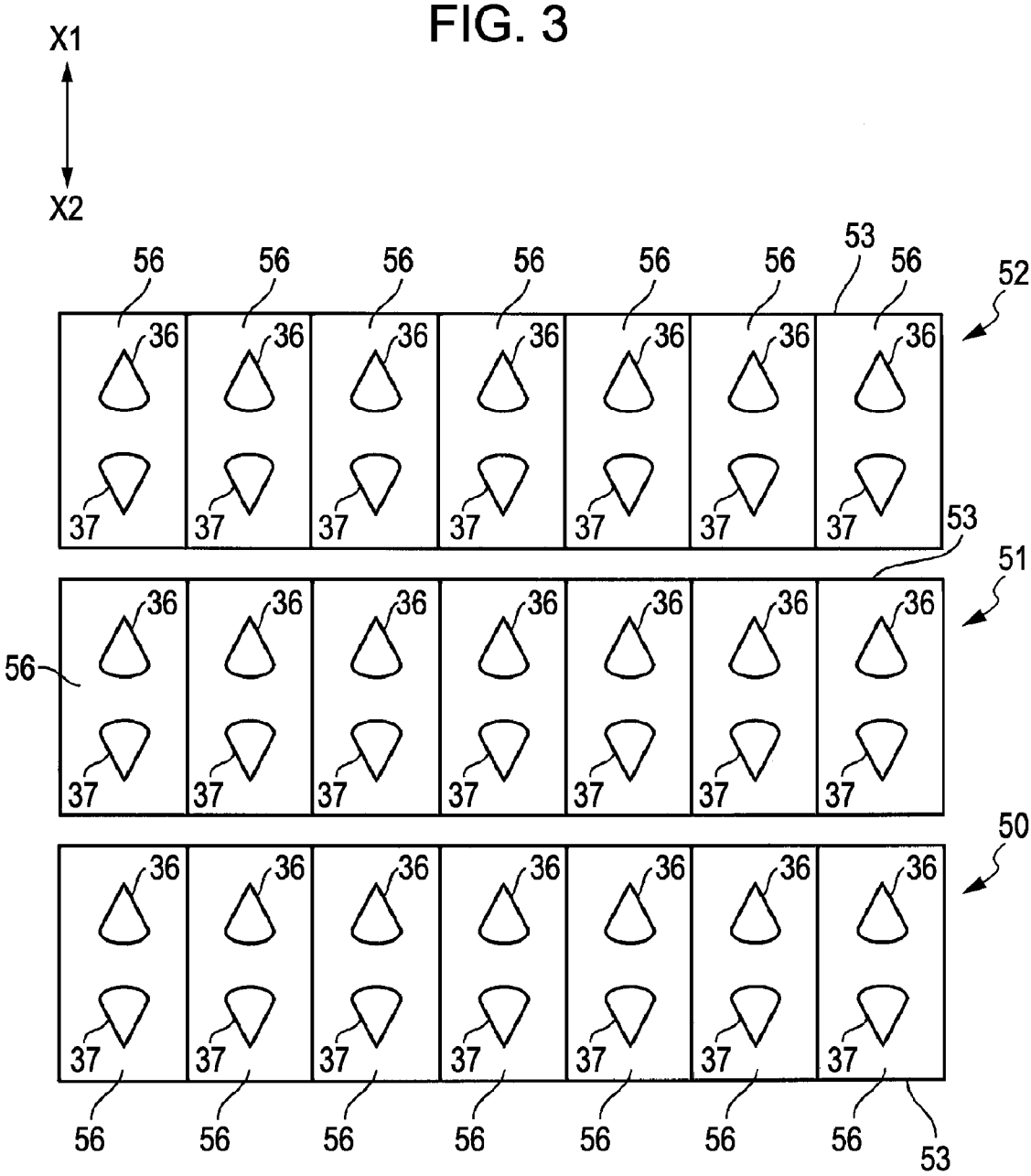
FIG. 3 is a schematic view illustrating arrangements of microwave irradiation units.

In the present embodiment, twenty-one microwave irradiation units 30 are provided and twenty-one pairs of the microwave irradiation portion 36 and the microwave incident portion 37 are provided. As shown in FIG. 3, the twenty-one pairs of the microwave irradiation portion 36 and the microwave incident portion 37 are arranged in seven rows in the left-right direction and in three rows in the front-rear direction along a transport surface of the sheet transport belt 35 on the upper side of the suction portion 39. Moreover, the pairs of the microwave irradiation portion 36 and the microwave incident portion 37 arranged in the front-rear direction are arranged in the front-rear direction, i.e., along the transport direction of the recording sheet P. Although FIG. 1 shows a state where they are arranged in three rows in the front-rear direction, seven pairs of the microwave irradiation portion 36 and the microwave incident portion 37 are also arranged each row so as to repeat toward the backside of the drawing sheet, i.e., toward the right side. In the following description, the microwave irradiation units 30 corresponding to each of the seven pairs of the microwave irradiation portion 36 and the microwave incident portion 37 on respective rows arranged in the front-rear direction will be regarded as one block and will be referred to a first block 50, a second block 51, and a third block 52, respectively, in the order starting from the rearmost row.

Figure 4:
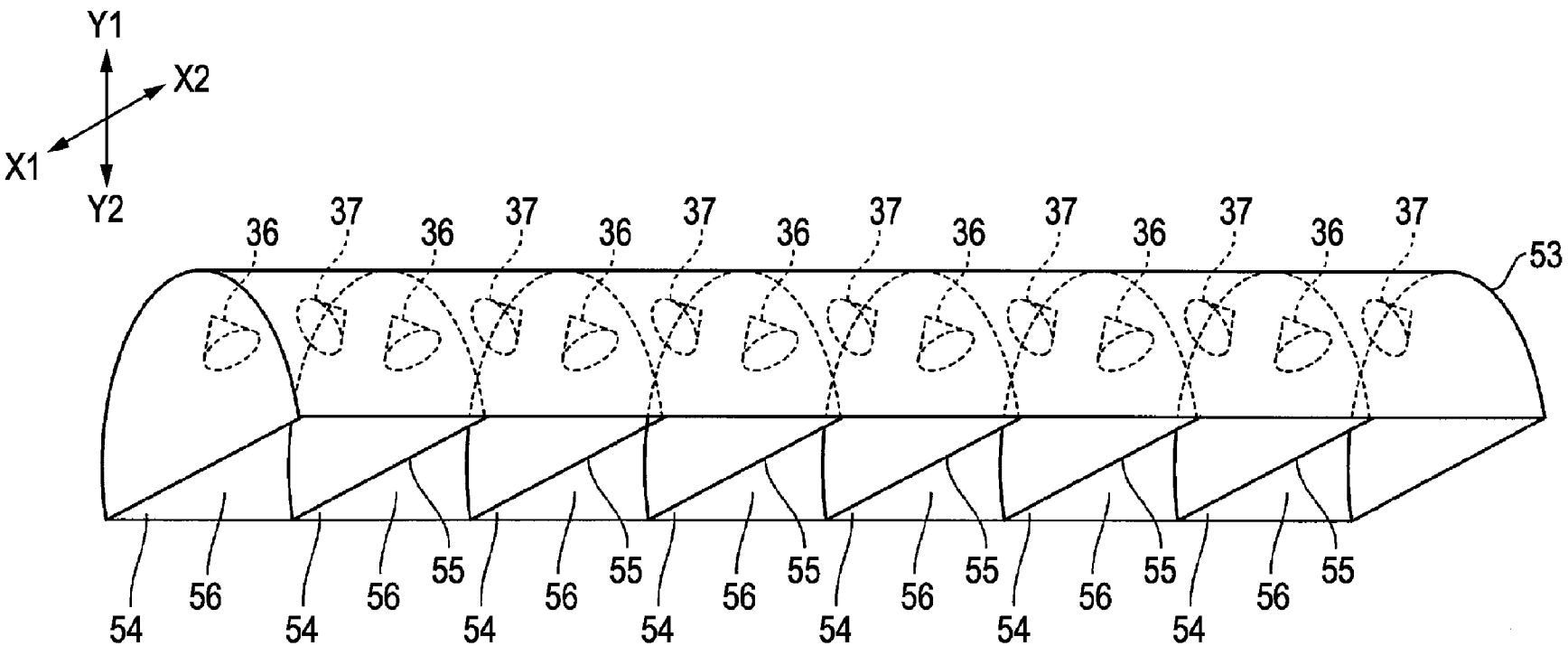
FIG. 4 is an oblique bottom perspective view of a first block.

A microwave absorption plate 53 is provided above the microwave irradiation portion 36 and the microwave incident portion 37 of each of the blocks 50, 51, and 52. FIG. 4 is an oblique bottom perspective view of the microwave irradiation portion 36 and the microwave incident portion 37 of the first block 50. The second block 51 and the third block 52 have the same structure.

The microwave absorption plate 53 has a half-cylindrical dome shape with an opening portion 54 being directed downward and the generating line of the cylinder extending in the left-right direction. Moreover, partition plates 55 are installed inside the half cylinder, so that the inside of the cylinder is divided into seven spaces 56 at equal intervals by the partition plates 55. Thus, each pair of the microwave irradiation portion 36 and the microwave incident portion 37 is contained in each space 56.

The microwave absorption plates 53 and the partition plates 55 are formed of material capable of block or absorb microwaves, such as a metal plate coated with black paint, for example. Owing to such a configuration, microwaves irradiated to the microwave irradiation portions 36 cannot be incident to the microwave incident portions 37 belonging to another pair, and thus, a shielding effect can be achieved. It is to be noted that the microwave absorption plates 53 and the partition plates 55 may be formed of other material as long as they can reflect or block microwaves. Moreover, the black paint coating on the metal plate may be applied only to the partition plates 55.

The sheet transport portions 29 and the respective blocks 50, 51, and 52 are covered by a microwave shielding casing 57 configured by a metal plate coated with black paint, for example, so that the microwaves irradiated from the microwave irradiation portions 36 cannot leak outside the microwave shielding casing 57.

The microwave irradiation portion 36 is connected via the waveguide 46 to the microwave oscillation circuit 45 that oscillates microwaves, and the microwave incident portion 37 is connected via the waveguide 48 to the microwave reception circuit 47 that receives the microwaves. Moreover, the microwave oscillation circuit 45 and the microwave reception circuit 47 are connected to the microwave control circuit 49.

The microwave oscillation circuit 45 is provided with a non-illustrated magnetron, so that microwaves are oscillated from the magnetron when electric voltage is supplied to the magnetron. The microwaves oscillated by the magnetron propagate through the waveguide 46 to be irradiated from the microwave irradiation portion 36 toward the recording sheet P. The respective microwave irradiation portions 36 are arranged such that the microwaves are irradiated to different portions of the recording sheet P being transported on the sheet transport belt 35.

Moreover, the respective microwave incident portions 37 are arranged such that the microwaves reflected from the recording sheet P after being irradiated to the recording sheet P from their pairing microwave irradiation portions 36 are incident thereon. In this case, portions of the microwaves irradiated to the recording sheet P from the respective microwave irradiation portions 36 are reflected from the recording sheet P to be incident to their pairing microwave incident portions 37. The microwaves incident to the respective microwave incident portions 37 propagate through the waveguide 48 to be received by microwave reception portions of the microwave reception circuits 47. In the respective microwave reception circuits 47, the microwaves are converted to voltage values corresponding to the amount of the received microwaves and the voltage values are output to the microwave control circuits 49.

In the respective microwave control circuits 49, microwaves are oscillated in accordance with an instruction from the system control portion 3 as microwave irradiation control means. The amount of the microwaves received by the respective microwave reception circuits 47 is output to the system control portion 3. Therefore, the system control portion 3 can control the oscillation of the microwaves by the microwave oscillation circuits 45 based on the received amount. Moreover, functions of the microwave irradiation control means are realized by the CPU 25 reading and executing control program stored in the PROM 26.

Operation of Heating Portion 2

Subsequently, a description of the operation of the heating portion 2 will be provided below.

The system control portion 3 includes, in addition to the above-described sheet feed motor driver 22 and the like related to control of the recording portion 1, a sheet transport motor driver 58 that controls the driving of the sheet transport motor 32 and a discharge motor driver 59 that controls the driving of the discharge motor 42, both of which serve as means for controlling the heating portion 2. The interface portion (I/Fd) 24 outputs the control signal from the system control portion 3 to the heating portion 2. Moreover, signals from the sheet detection sensor 40, the rotation detection sensor 41, and the microwave irradiation unit 30 are supplied to the system control portion 3 via the interface portion (I/Fd) 24.

The control portion 21 calculates the position or the transport amount of the recording sheet P based on the signals delivered from the sheet detection sensor 40 and the rotation detection sensor 41. Moreover, the control portion 21 operates the suction portion 39 so that the recording sheet P transported from the heating portion 2 to the sheet discharge portion 31 is attracted toward the sheet transport belt 35. Furthermore, the control portion 21 issues a control command to the respective microwave control circuits 49 so that predetermined microwaves are oscillated based on the received amount of the microwaves by the respective microwave reception circuits 47.

Figure 5:
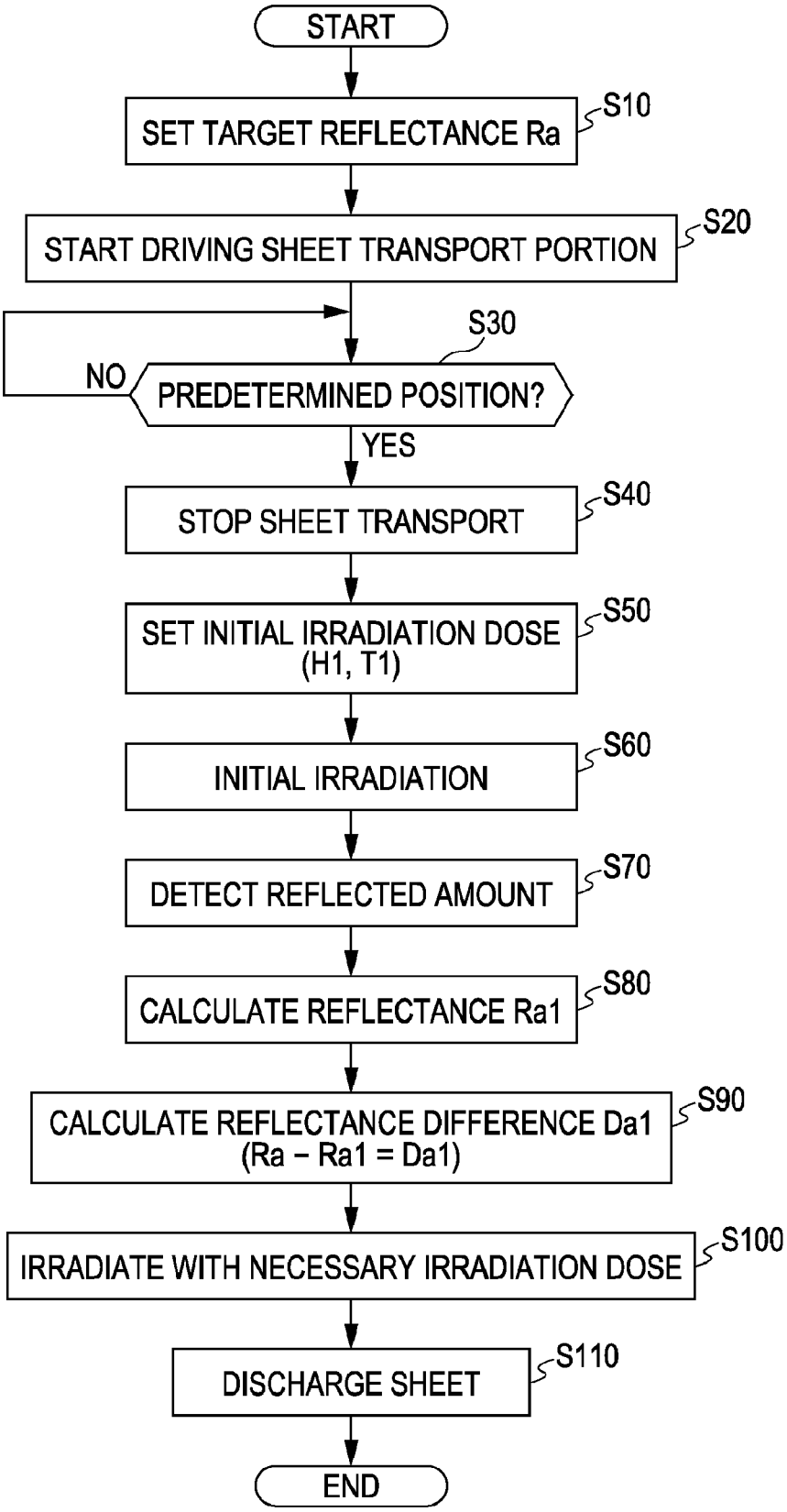
FIG. 5 is a flow chart showing an operation of a heating portion according to a first embodiment of the present invention.

The operation of the heating portion 2 will be described with reference to the flow chart of FIG. 5.

Overall Operation of Heating Portion 2

An overall operation of the heating portion 2 is as follows. In the heating portion 2, the recorded recording sheet P conveyed from the recording portion 1 is transported to a predetermined position. The recording sheet P conveyed from the recording portion 1 is wet with the solvent of ink as it is immediately after being applied with the ink. First, a predetermined amount of microwaves is irradiated to the wet recording sheet P being conveyed to the predetermined position as an initial irradiation from the respective microwave irradiation portions 36. The amount of the microwaves reflected from the recording sheet P during the initial irradiation is detected by the microwave reception circuit 47, thus determining a dryness level (moisture level) of the recording sheet P based on the reflected amount. Then, the CPU 25 calculates an irradiation dose of the microwaves necessary for changing the dryness level of the recording sheet P to a predetermined dryness level so that the necessary irradiation dose of microwaves is irradiated to the recording sheet P. By the irradiation of the necessary irradiation dose of microwaves, the recording sheet P is heated to accelerate the drying of the recording sheet P. In this way, the heating portion 2 detects the dryness level of the recording sheet P and irradiates an amount of microwaves corresponding to the detected dryness level, thereby accelerating the drying of the recording sheet P while preventing excessive heating of the recording sheet P.

Figure 6A:
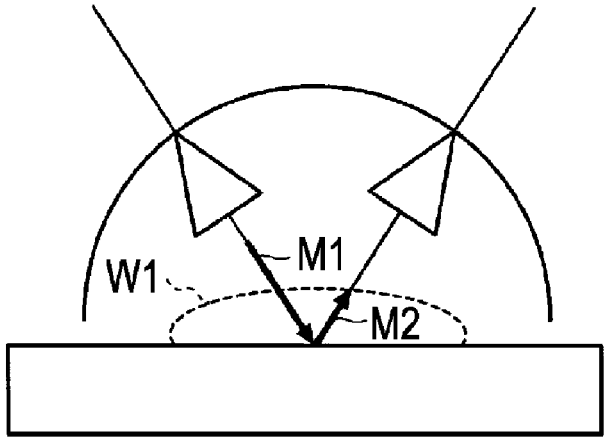
FIGS. 6A and 6B are views showing the relationship between a dryness level (i.e., a moisture level) of a recording sheet and a reflected amount of microwaves.
Figure 6B:
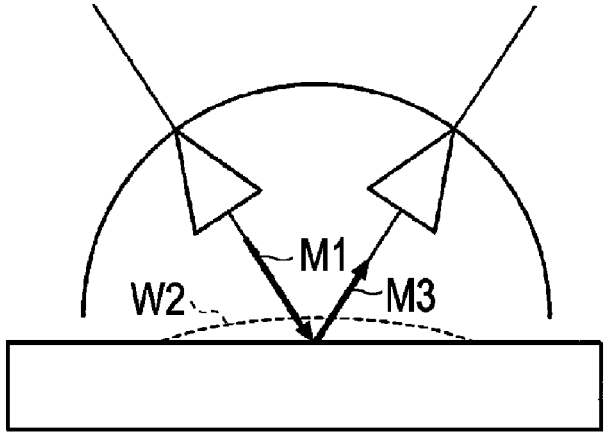

Now, by reference to FIGS. 6A and 6B, the relationship between a dryness level (a moisture level) of the recording sheet P and a reflected amount of microwaves will be described. FIG. 6A schematically shows a state where much moisture W1 is contained in the recording sheet P. On the other hand, FIG. 6B shows a state where the amount of moisture W2 contained in the recording sheet P is smaller than that shown in FIG. 6A and drying is in progress.

The microwaves have a characteristic that they are absorbed in moisture and an amount of heat therein changes depending on the absorption amount. Specifically, when microwaves of the same irradiation dose M1 are irradiated to the recording sheets P having the dryness levels shown in FIGS. 6A and 6B, the reflected amount M2 for FIG. 6A and the reflected amount M3 for FIG. 6B satisfy a relation of $M2<M3$. That is, when microwaves are irradiated to a portion having much moisture, a large amount of the microwaves will be absorbed in the moisture while a small amount of the microwaves will be reflected from the moisture. To the contrary, when microwaves are irradiated to a portion having less moisture, a small amount of the microwaves will be absorbed in the moisture while a large amount of the microwaves will be reflected from the moisture.

As is obvious from the above, the reflected amount of the microwaves varies depending on the amount of moisture contained in the portion to which the microwaves are irradiated. Therefore, it is possible to know the dryness level of an irradiating portion by calculating an amount of the microwaves absorbed in the irradiating portion to which the microwaves are irradiated, from the irradiated amount of the microwaves and the reflected amount of the microwaves. In other words, it is possible to know the dryness level of the irradiating portion from a reflectance which is a ratio of the irradiation dose of the microwaves and the reflected amount of the microwaves. Therefore, in the heating portion 2, the dryness level of a portion where the microwaves are irradiated is calculated from the reflectance of the microwaves at the irradiating portion so that the microwaves of an irradiation dose corresponding to the dryness level are irradiated to the irradiating portion, thus preventing the irradiating portion from being excessive heated.

Detailed Operation of Heating Portion 2

A detailed description of the operation of the heating portion 2 will be provided hereinbelow.

When the printer 100 is activated by a non-illustrated power switch-on, the heating portion 2 starts operating together with the recording portion 1. In the heating portion 2, first, a later-described target reflectance Ra (see step S90) is set (see step S10). Then, following the recording portion 1 starting its recording operation, the sheet transport portion 29 starts its operation (step S20). That is, following the sheet feed motor 7 and the sheet transport motor 10 starting their operations, the sheet transport motor 32 and the suction portion 39 start their operations. In this way, the recording sheet P discharged toward the heating portion 2 after being recorded in the recording portion 1 is transported frontward by the sheet transport belt 35.

The transport position of the recording sheet P being transported on the sheet transport belt 35 is detected based on the outputs from the sheet detection sensor 40 and the rotation detection sensor 41, and a determination is made as to whether or not the recording sheet P has been transported to a predetermined position at which a leading end thereof reaches a microwave irradiation area Ar3 where microwaves are irradiated by the microwave irradiation portion 36 of the first block 50 (step S30).

When the recording sheet P has been transported to the predetermined position (step S30: Yes), the transport of the recording sheet P stops (step S40). Then, the CPU 25 sets an irradiation dose S1 for performing a later-described initial irradiation (see step S60) for each of the microwave irradiation units 30 (step S50). Specifically, a field intensity H1 and an irradiation time T1 of the microwaves during the initial irradiation are set as the irradiation dose for the initial irradiation. Then, the respective microwave irradiation units 30 perform the initial irradiation wherein microwaves of the field intensity H1 are irradiated to the recording sheet P for a predetermined irradiation time T1 (step S60).

As described above, in the present embodiment, each of the blocks 50, 51, and 52 is provided with seven microwave irradiation units 30, and therefore, the heating portion 2 has twenty-one microwave irradiation units 30 in total. Moreover, the irradiation directions of the microwaves by the respective microwave irradiation units 30 are set such that when the recording sheet P has been transported to the predetermined position (at which the leading end of the recording sheet P reaches the irradiation area Ar3), different portions of the recording sheet P are irradiated by the microwave irradiation units 30, so that the entire surface of the recording sheet P are irradiated with the microwaves. That is, the irradiation directions of the microwaves by the respective microwave irradiation portions 36 are set such that the twenty-one microwave irradiation portions 36 irradiate microwaves to predetermined different portions of the recording sheet P being transported to the predetermined position, so that the entire surface of the recording sheet P are irradiated with the microwaves.

The respective microwave incident portions 37 are arranged at positions to which the microwaves reflected from the recording sheet P after being irradiated by the microwave irradiation portions 36 paired with the microwave incident portions 37 are incident. Therefore, when the initial irradiation is performed on the recording sheet P from the respective microwave irradiation portions 36 (step S60), the microwaves reflected from the recording sheet P after being irradiated by the pairing microwave irradiation portions 36 are incident to the respective microwave incident portions 37.

The microwave irradiation units 30 measure the reflected amount of the microwaves incident to the microwave incident portions 37 by means of the microwave control circuits 49 and deliver the measured amount to the control portion 21 (step S70). Then, the CPU 25 calculates the reflectance Ra1 of the microwaves incident to and reflected from the recording sheet P from the reflected amount of the microwaves incident to the microwave incident portions 37 and the irradiation dose of the microwaves irradiated as the initial irradiation from the microwave irradiation portions 36 (step S80). The reflectance Ra1 is calculated for each microwave irradiation unit 30. The reflectance Ra1 has a value corresponding to the amount of moisture contained in the irradiating portion to which the microwaves are irradiated. That is, in portions where a large amount of ink is applied and thus contains a large amount of moisture, the amount of microwaves absorbed in moisture is small and the reflectance Ra1 is large. To the contrary, in portions where a small amount of ink is applied and thus contains a small amount of moisture, the amount of microwaves absorbed in moisture is small and the reflectance Ra1 is large. That is, by performing the initial irradiation (step S60), it is possible to measure the dryness level of the irradiating portion from the reflectance Ra1. Here, the initial irradiation dose of the microwaves irradiated from the microwave irradiation portions 36 is stored in the EEPROM 28.

Subsequently, the CPU 25 calculates a reflectance difference Da1 (=Ra−Ra1), which is a difference between the reflectance Ra1 and the target reflectance Ra: this calculation is performed for each microwave irradiation unit 30 (step S90). The target reflectance Ra is defined as a reflectance obtained when microwaves are irradiated to a recorded portion that is dried to a predetermined dryness level, for example, at which even when the recorded portion having ink applied thereon are touched, the ink must not be blurred by rubbing. The target reflectance Ra is predetermined through experiments depending on the type of a recording sheet P and ink used and the like. Then, the CPU 25 calculates an irradiation dose of microwaves necessary for changing the dryness level of the irradiating portions corresponding to the respective microwave irradiation units 30 to a predetermined dryness level based on the reflectance difference Da1, so that microwave waves of a field intensity and an irradiation time corresponding to the necessary irradiation dose are irradiated to the recording sheet P from the respective microwave irradiation portions 36 (step S100).

The necessary irradiation dose can be calculated, for example, as follows. When the reflectance difference Da1 is 0 or smaller, it can be judged that the irradiating portion is dried to the predetermined dryness level or higher. Therefore, in such a case, it is not necessary to irradiate microwaves, and the irradiation dose of the microwaves is set to 0 because additional irradiation of microwaves may result in overheating. Particularly, for example, portions with no ink applied thereon are portions which are dried to the predetermined dryness level or higher, and therefore, it is not necessary to irradiate microwaves thereto.

When the reflectance difference Da1 is greater than 0, it can be judged that the dryness level of the irradiating portion is lower than the predetermined dryness level. The amount of microwaves absorbed in the moisture contained in the irradiating portion can be known from the reflectance difference Da1 and the irradiation dose of microwaves during the initial irradiation, and the amount of the absorbed microwaves corresponds to the amount of moisture contained in the irradiating portion. That is, the reflectance difference Da1 corresponds to the amount of the moisture contained in the irradiating portion having the reflectance difference Da1: that is, the reflectance difference Da1 corresponds to the dryness level of the irradiating portion. The necessary irradiation dose is preliminarily stored in the PROM 26 as a table by calculating through experiments the relationship between the reflectance difference Da1 and the amount (field intensity and irradiation time) of microwaves necessary for changing the dryness level of the irradiating portion having the reflectance difference Da1 to the predetermined dryness level. Therefore, it is possible to calculate the necessary irradiation dose corresponding to the reflectance difference Da1 by referring to the table.

The respective microwave irradiation units 30 calculate the necessary irradiation dose for changing the dryness level of the irradiating portions corresponding to the respective microwave irradiation units 30 to the predetermined dryness level and irradiate the microwaves of the necessary irradiation dose to the recording sheet P (step S100), thereby allowing the irradiating portions corresponding to the respective microwave irradiation units 30 to be dried to the predetermined dryness level while being prevented from being excessively heated. After the microwaves of the predetermined necessary irradiation dose have been irradiated, the sheet transport portion 29 and the sheet discharge portion 31 are caused to resume their operations so that the recording sheet P is discharged to the stacker (not shown) (step S110).

As described above, because the initial irradiation (step S60) mainly aims to detect the dryness level of the irradiating portion, the dryness level of the irradiating portion is not yet known at the time of performing the initial irradiation. Therefore, if the irradiation dose for the initial irradiation is too high, the irradiating portion having a high dryness level may be excessively heated, and thus, the recording sheet P may undesirably catch fire or be deteriorated with intense heat. Therefore, it is desirable that the irradiation dose of the microwaves during the initial irradiation is set to a low irradiation dose, assuming that the irradiating portion is dried to some extent.

The heating portion 2 of the printer 100 is provided with a plurality of microwave irradiation portions 36 and has a configuration in which the respective microwave irradiation portions 36 irradiate microwaves always to the same portions, and the respective microwave irradiation portions 36 irradiate the respective portions, so that the entire surface of the recording sheet P is irradiated with microwaves. Alternatively, a configuration may be used in which the irradiation direction of the microwaves by the microwave irradiation portion 36 is changed so that the microwaves irradiated from the microwave irradiation portion 36 scan over the surface of the recording sheet P. By using such a configuration, it is possible to decrease the number of microwave irradiation portions 36, thus miniaturizing the heating portion 2.

Second Embodiment

Next, a printer 200 as a recording apparatus according to a second embodiment of the present invention will be described. The printer 200 has approximately the same structure as the printer 100, except for the operation of the heating portion 2 of the printer 100. That is, the printer 200 has the same structure as the printer 100 shown in FIGS. 1 and 2, but differs from the printer 100 in the operation of the heating portion 2. In the following description, the printer 200 will be described mainly with respect to the operation of the heating portion 2 of the printer 200.

Figure 7:
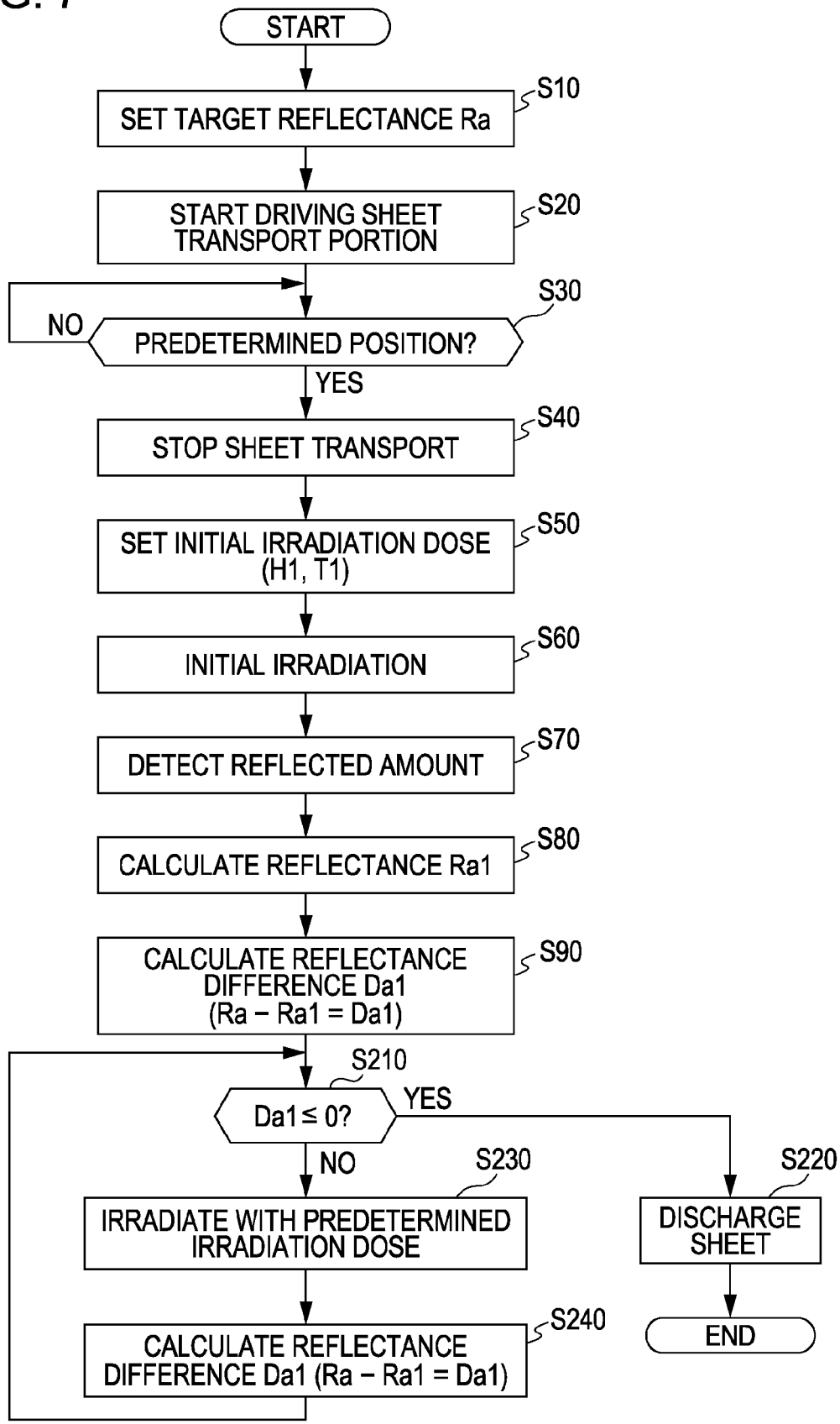
FIG. 7 is a flow chart showing an operation of a heating portion according to a second embodiment of the present invention.

The printer 100 according to the first embodiment has a configuration in which subsequent to the initial irradiation, an irradiation of microwaves of the necessary irradiation dose corresponding to the reflectance difference Da1 calculated during the initial irradiation is performed once, so that the irradiating portion which has not been dried to the predetermined dryness level is caused to be dried to the predetermined dryness level by the single subsequent irradiation of the microwaves. To the contrary, the printer 200 according to the second embodiment has a configuration in which an irradiation of microwaves of an irradiation dose smaller than the necessary irradiation dose capable of obtaining the predetermined dryness level through a single subsequent irradiation is performed several times, so that the dryness level of the irradiating portion gradually approaches the predetermined dryness level. The operation of the heating portion 2 of the printer 200 according to the second embodiment is shown in the flow chart of FIG. 7. Operations of steps S10 to S90 are the same as those of the printer 100, and a redundant description thereof will be omitted.

In the printer 200, when by performing the initial irradiation (step S60), the reflected amount is detected (step S70), the reflectance Ra1 is calculated (step S80), and the reflectance difference Da1 (=Ra−Ra1) is calculated (step S90), the CPU 25 makes a determination for each microwave irradiation unit 30, as to whether or not the reflectance difference Da1 satisfies a relation of Da1<0 (step S210). When the reflectance difference satisfies the relation of Da1<0 in every microwave irradiation unit 30 (step S210: Yes), it is judged that the irradiating portions corresponding to the respective microwave irradiation units 30 are dried to the predetermined dryness level, and the sheet transport portion 29 and the sheet discharge portion 31 are caused to resume their operations so that the recording sheet P is discharged to the stacker (not shown) (step S220).

When among the microwave irradiation units 30, there is an irradiating portion in which the reflectance difference satisfies a relation of Da1>0 (step S210: No), the irradiating portion corresponding to the microwave irradiation unit 30 in which the reflectance difference satisfies the relation of Da1>0 can be judged that it is not dried to the predetermined dryness level. Therefore, in order to additionally heat and dry the irradiating portion in which the reflectance difference satisfies the relation of Da1>0, microwaves of a predetermined irradiation dose are irradiated to the irradiating portion (step S230). The predetermined irradiation dose can be calculated based on Formula 1 as follows.

$$S2=S1+k1\times Da1\times S1 \qquad \text{Formula 1}$$

S1: initial irradiation dose
S2: predetermined irradiation dose
k1: positive proportional constant
Da1: reflectance difference When microwaves of the predetermined irradiation dose S2 are irradiated based on Formula 1, the irradiating portion which has not been dried to the predetermined dryness level and in which the reflectance difference satisfies the relation of Da1>0 is irradiated with microwaves of the predetermined irradiation dose S2 which is greater than the initial irradiation dose S1 by an amount of k1×Da1×S1. Moreover, since the irradiating portion in which the reflectance difference satisfies the relation of Da1<0 is dried to the predetermined dryness level or higher, no further drying is required, and thus, the irradiation of the microwaves is not performed on this portion.

The proportional constant k is used to determine an appropriate range of an increase or a decrease in the irradiation dose of microwaves from the initial irradiation dose S1. For example, when the predetermined irradiation dose S2 is set to an irradiation dose which is greater than the initial irradiation dose S1 by the fraction of the reflectance difference Da1, that is, S2=S1+Da1×S1 (in case of K1=1), if there is a fear that the irradiation dose of microwaves irradiated to the irradiating portion becomes excessively great and the irradiating portion is excessively heated, an appropriate value smaller than 1 is selected as the proportional constant k1. By doing so, the predetermined irradiation dose S2 can be determined as an irradiation dose at which the irradiating portion is prevented from being excessively heated. To the contrary, when it is difficult to sufficiently accelerate the drying by merely irradiating the microwaves of an irradiation dose (S1+Da1×S1) higher than the initial irradiation dose S1 by the fraction of the reflectance difference Da1, by selecting an appropriate value greater than 1 as the proportional constant k1, the drying can be effectively accelerated.

The proportional constant k1 can be determined by preliminarily calculating through experiments the relationship between the reflectance difference Da1 and the amount (field intensity and irradiation time) of the microwaves necessary for changing the dryness level of the irradiating portion having the reflectance difference Da1 to a predetermined dryness level.

As described above, although it is not necessary to perform the irradiation of microwaves on the irradiating portion (in which the reflectance difference satisfies the relation of Da1<0) which is dried to an extent equal to or greater than the target reflectance Ra, the irradiating portion may be irradiated with microwaves of an irradiation dose determined based on Formula 1 within a range in which overheating is prevented. By doing so, it is possible to increase the dryness level of the irradiating portion which is dried to an extent equal to or greater than the target reflectance but not to the perfect extent.

After the microwaves of the predetermined irradiation dose S2 are irradiated, the reflectance difference Da1 in the irradiating portion irradiated with the microwaves of the predetermined irradiation dose S2 is calculated (step S240), and a determination is made as to whether the reflectance difference satisfies a relation of Da1<0 (step S210). When the reflectance difference satisfies the relation of Da1<0 in every microwave irradiation unit 30 (step S210: Yes), it is judged that the irradiating portions corresponding to the respective microwave irradiation units 30 are dried to the predetermined dryness level, and the sheet transport portion 29 and the sheet discharge portion 31 are caused to resume their operations so that the recording sheet P is discharged to the stacker (not shown) (step S220).

When among the irradiating portions, there is an irradiating portion in which the reflectance difference does not satisfy the relation of Da1<0 (step S210: No), the above-described operations of steps S230 and S240 are performed on the irradiating portion. The operations of steps S210, S230, and S240 are repeated until all the irradiating portions satisfies the reflectance difference relation of Da1<0, and when the reflectance difference relation of Da1<0 is satisfied in every irradiating portions (step S210: Yes), the recording sheet P is discharged (step S220).

The predetermined constant k1 is determined as a value based on the reflectance difference Da1 so that the reflectance difference relation of Da1<0 is satisfied when the irradiation with the predetermined irradiation dose S2 has been performed at least twice in step S230. By determining the predetermined constant k1 in such a manner, the irradiating portion can be heated so that a dryness level thereof gradually approaches the predetermined dryness level by several irradiations subsequent to the initial irradiation, instead of changing the dryness level directly to the predetermined dryness level by a single subsequent irradiation. Owing to such a configuration, it is possible to suppress the drying stress generated when the recording sheet P is abruptly dried, thus preventing deformation such as rippling or curling of the recording sheet P. When microwaves are irradiated at once in a large amount corresponding to an irradiation dose necessary for changing the dryness level of the irradiating portion to the predetermined dryness level, there is a fear that the irradiating portion catches fire or is deteriorated with intense heat. However, by irradiating the irradiating portion with the microwaves of the necessary irradiation dose in several times, it is possible to heat the irradiating portion at high temperature at which the irradiating portion is prevented from catching fire or being deteriorated.

The heating portion 2 of the printer 200 is provided with a plurality of microwave irradiation portions 36 and has a configuration in which the respective microwave irradiation portions 36 irradiate microwaves always to the same portions, and the respective microwave irradiation portions 36 irradiate the respective portions, so that the entire surface of the recording sheet P is irradiated with microwaves. Alternatively, a configuration may be used in which the irradiation direction of the microwaves by the microwave irradiation portion 36 is changed so that the microwaves irradiated from the microwave irradiation portion 36 scan over the surface of the recording sheet P. In such a case, the microwaves are caused to scan the same portion several times so that a present irradiation dose of the microwaves may be determined based on a reflectance calculated during the previous scanning. By using such a configuration, it is possible to decrease the number of microwave irradiation portions 36, thus miniaturizing the heating portion 2.

Third Embodiment

Next, a printer 300 as a recording apparatus according to a third embodiment of the present invention will be described. Similar to the printer 200, the printer 300 has approximately the same structure as the printer 100, except for the operation of the heating portion 2. That is, the printer 300 has the same structure as the printer 100 shown in FIGS. 1 and 2, but differs from the printer 100 in the operation of the heating portion 2. In the following description, the printer 300 will be described mainly with respect to the operation of the heating portion 2 of the printer 300.

The printer 200 according to the second embodiment has a configuration in which in a state where the recording sheet P is stopped at a predetermined position (at which the leading end of the recording sheet P is aligned with the irradiation area Ar3), the respective microwave irradiation units irradiate microwaves of the predetermined irradiation dose so that the dryness level of the respective irradiating portions corresponding thereto is changed to the predetermined dryness level. That is, when the initial irradiation ends, the respective irradiating portion are caused to be irradiated with the microwaves by the same microwave irradiation portions 36 until the dryness level thereof is changed to the predetermined dryness level. To the contrary, the printer 300 according to the third embodiment has a configuration in which it is not necessary to stop the transport of the recording sheet P during the irradiation of microwaves, and when the irradiating portion passes the microwave irradiation portions 36 from the first block 50 to the third block 52, the respective blocks 50, 51, and 52 irradiate microwaves of an irradiation dose corresponding to the dryness level of the recorded portion passing through the respective blocks 50, 51, and 52. Therefore, the dryness level of the irradiating portion can be gradually changed to approach the predetermined dryness level when the irradiating portion passes through the microwave irradiation portions 36 from the first block 50 to the third block 52.

Figure 8:
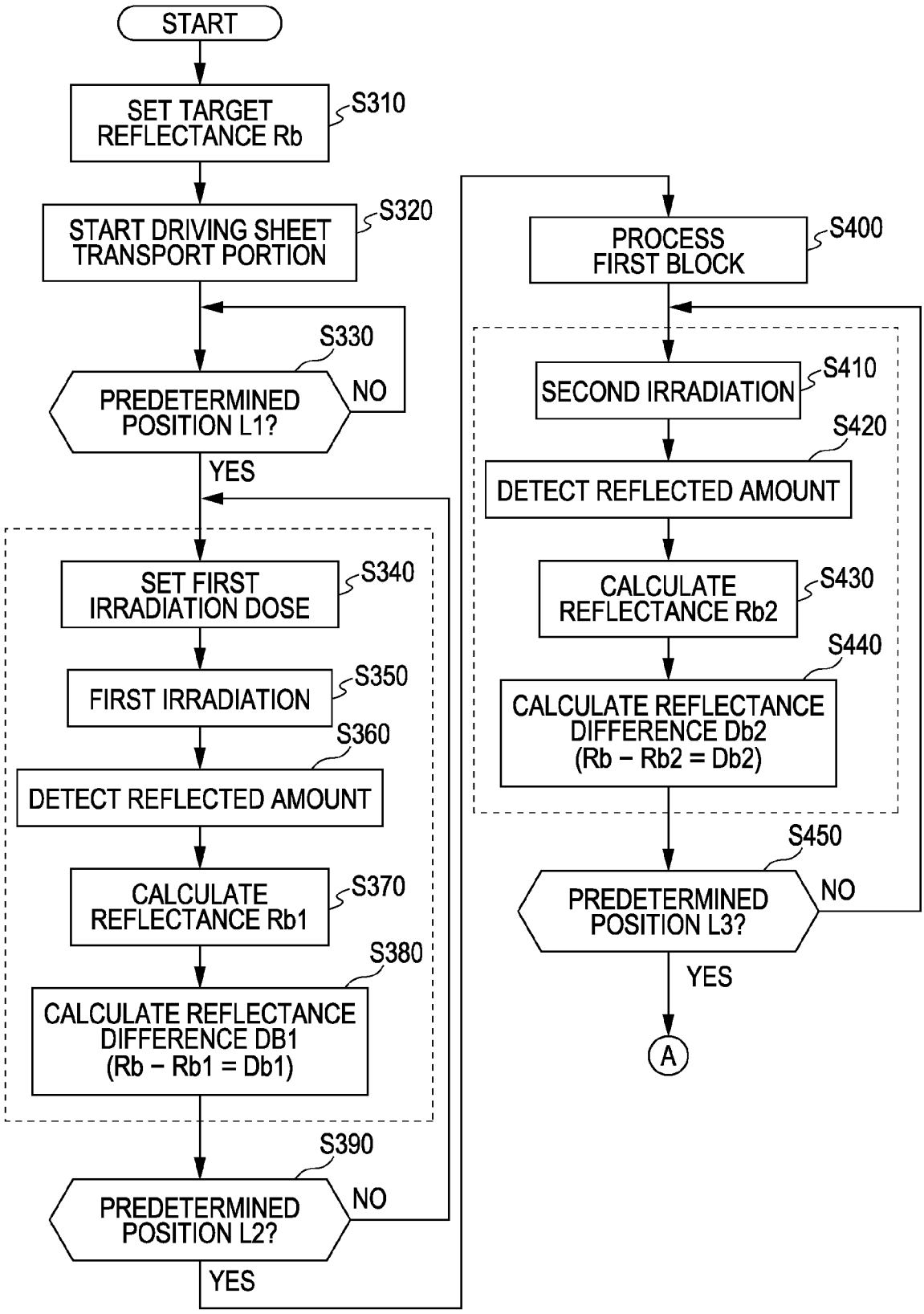
FIG. 8 is a flow chart showing an operation of a heating portion according to a third embodiment of the present invention.
Figure 9:
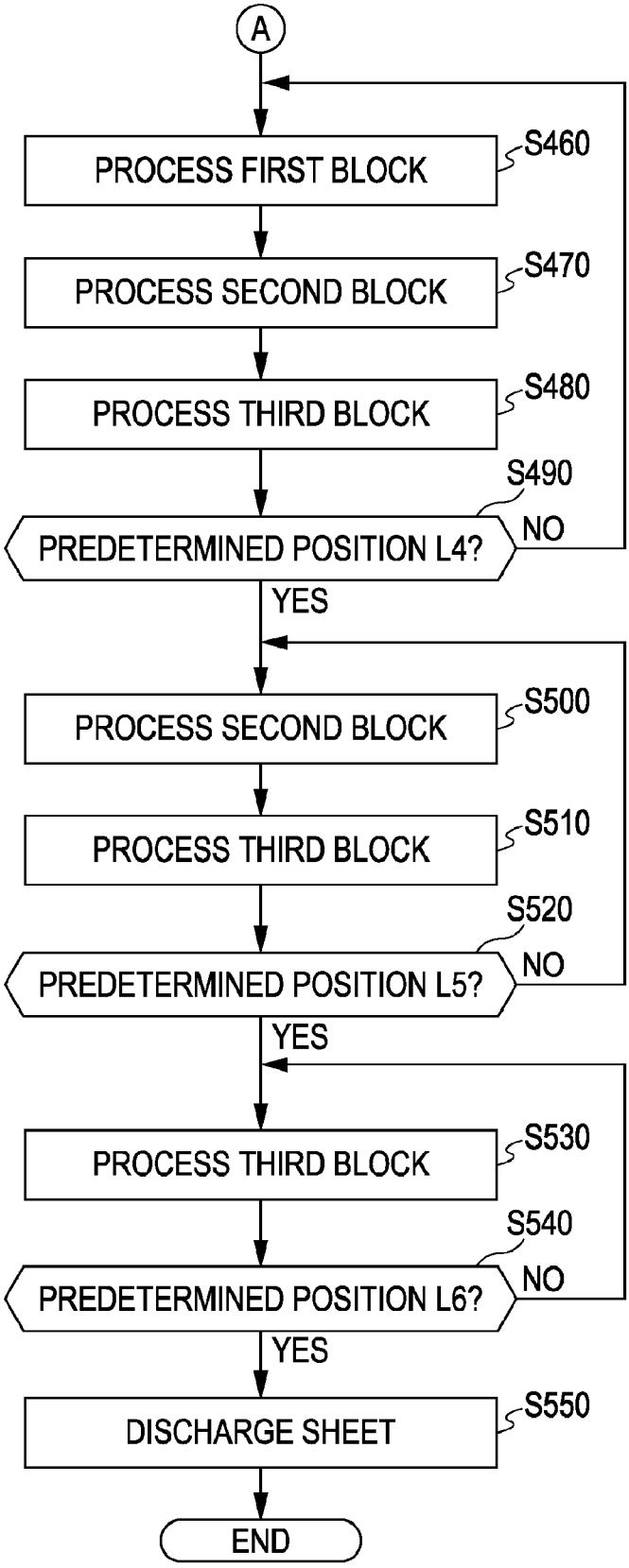
FIG. 9 is a flow chart showing the operation of the heating portion according to the third embodiment.

The operation of the heating portion 2 of the printer 300 according to the third embodiment is shown in the flow charts of FIGS. 8 and 9. FIGS. 10A to 10F show the transport positions of the recording sheet P in the heating portion 2 with the lapse of time.

When the printer 300 is activated by a non-illustrated power switch-on, the heating portion 2 starts operating together with the recording portion 1. In the heating portion 2, first, a later-described target reflectance Rb (see step S380) is set (step S310). Then, following the recording portion 1 starting its recording operation, the sheet transport portion 29 starts its operation (step S320). In this way, the recording sheet P discharged toward the heating portion 2 after being recorded in the recording portion 1 is transported frontward by the sheet transport belt 35.

Figure 10A:
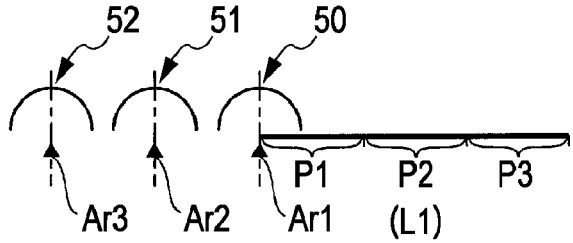
FIGS. 10A to 10F are views showing a transport position of a recording sheet according to the third embodiment.

The transport position of the recording sheet P being transported on the sheet transport belt 35 is detected based on the outputs from the sheet detection sensor 40 and the rotation detection sensor 41, and a determination is made as to whether or not the recording sheet P has been transported to a predetermined position L1 shown in FIG. 10A (step S330).

As shown in FIG. 10A, the predetermined position L1 corresponds to a position at which the leading end of the recording sheet P reaches a microwave irradiation area Ar1 where microwaves are irradiated by the microwave irradiation portion 36 of the first block 50. When the recording sheet P has been transported to the predetermined position L1 (step S330: Yes), an irradiation dose (field intensity H2) of the microwaves for performing a later-described first irradiation (step S350) is set for each microwave irradiation unit 30 of the first block 50 (step S340). The irradiation dose of microwaves set in step S340 is set to a low irradiation dose at which the recording sheet P is prevented from catching fire or being deteriorated with intense heat even when the microwaves are irradiated, assuming a case where the amount of ink applied to the irradiating portion is small and the dryness level of the irradiating portion is high. Thereafter, the microwaves of the irradiation dose set in step S340 are irradiated as the first irradiation to the recording sheet P from the respective microwave irradiation portions 36 of the first block 50 (step S350).

In this case, portions of the microwaves irradiated as the first irradiation (step S350) to the recording sheet P from the respective microwave irradiation portions 36 of the first block 50 are reflected from the irradiating portion to be incident to the respective microwave incident portions 37 paired with the microwave irradiation portions 36 which had performed the first irradiation. The respective microwave irradiation unit 30 of the first block 50 measure the reflected amount of the microwaves incident to the respective microwave incident portions 37 and deliver the measured amount to the control portion 21 (step S360). Then, the CPU 25 calculates the reflectance Rb1 of the microwaves at the irradiating portion from the reflected amount of the microwaves incident to the microwave incident portions 37 of the first block 50 and the irradiation dose of the microwaves irradiated as the first irradiation from the microwave irradiation portions 36 (step S370). The reflectance Rb1 is calculated for each microwave irradiation unit 30 of the first block 50.

Then, a reflectance difference Db1 (=Rb−Rb1), which is a difference between the reflectance Rb1 and a target reflectance Rb, is calculated and stored in the EEPROM 28 (step S380). Similar to the target reflectance Ra described above, the target reflectance Rb is defined as a reflectance obtained when microwaves are irradiated to a recorded portion that is dried to a predetermined dryness level, for example, at which even when the recorded portion having ink applied thereon are touched, the ink must not be blurred by rubbing: the target reflectance Rb is calculated through experiments. It is to be noted that the target reflectance Rb may be set to a value slightly lower than the reflectance corresponding to the predetermined dryness level, considering an increase in the dryness level during a period between the end of the first irradiation to the irradiating portion and the start of discharging.

Figure 10B:
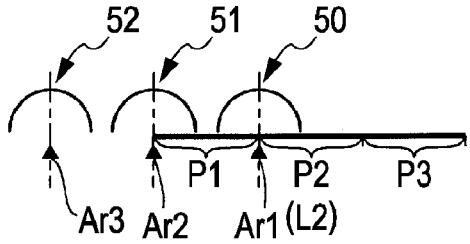

The above-described operations of steps S350 to S380 are repeated until the recording sheet P is transported to a predetermined position L2 shown in FIG. 10B. Specifically, the operations of steps S350 to S380 are performed on an irradiating range P1 that passes through the irradiation area Ar1. That is, when the respective microwave irradiation units 30 of the first block 50 continuously perform the first irradiation on the recording sheet P passing the irradiation area Ar1, the microwaves of the first irradiation reflected from the irradiating portion passing the irradiation area Ar1 are continuously incident to the microwave incident portions 37 of the first block 50. The predetermined position L2 corresponds to a position at which the leading end of the recording sheet P reaches a microwave irradiation area Ar2 where microwaves are irradiated by the microwave irradiation portions 36 of the second block 51.

Focusing on one arbitrary pair of the microwave irradiation portion 36 and the microwave incident portion 37 in the first block 50, and more specifically, with respect to the irradiating portion passing the irradiation area Ar1 (that is, a portion irradiated with the microwaves from the microwave irradiation portion 36 of the one arbitrary pair of the microwave irradiation portion 36 and the microwave incident portion 37), the relationship between the irradiation dose (field intensity H2) of the microwaves during the first irradiation and the reflectance Rb1 of the irradiating portion irradiated by the first irradiation can be expressed as a graph shown in FIGS. 11A1 and 11A2, for example.

As shown in FIG. 11A1, in the first irradiation which is performed during a period in which the recording sheet P is transported from the predetermined position L1 to the predetermined position L2, the microwaves are irradiated at a constant field intensity H2. On the other hand, as shown in FIG. 11A2, the reflectance Rb1 varies in response to the dryness level of the recorded portion passing the irradiation area Ar1. The respective reflectance values Rb1 at areas between Pa1 to Pa4 shown in FIG. 11A2 are examples showing a change in the reflectance Rb1 in the irradiating range P1 that has passed the irradiation area Ar1 of the recording sheet P. The dryness level of the recorded portion depends on, for example, the amount of the moisture contained in the ink solvent, and the moisture amount depends on the amount of ink applied on the recording portion.

In the example shown in FIG. 11A2, in a range of areas extending between a point Pa1 corresponding to the leading end of the recording sheet P and a rearward point Pa2, the reflectance Rb1 is lower than the target reflectance Rb. That is, the dryness level in the range of areas between Pa1 and Pa2 is lower than the predetermined dryness level. Moreover, in a range of areas between Pa2 and Pa3, the reflectance Rb1 is higher than the target reflectance Rb. That is, the dryness level in the range of areas between Pa2 and Pa3 is higher than the predetermined dryness level. Furthermore, in a range of areas between Pa3 and Pa4, the reflectance Rb1 is lower than the target reflectance Rb. That is, the dryness level in the range of areas between Pa3 and Pa4 is lower than the predetermined dryness level.

In the case of the reflectance Rb1 shown in FIG. 11A2, the reflectance difference Db1 has a positive value larger than 0 in the range of areas between Pa1 and Pa2, a negative value smaller than 0 in the range of areas between Pa2 and Pa3, and a positive value larger than 0 in the range of areas between Pa3 and Pa4.

When the recording sheet P is transported from the predetermined position L1 to the predetermined position L2 (steps S330 to S390), the above-described operations of steps S340 to S380 are repeated, whereby the reflectance difference Db1 corresponding to the position of the irradiating portion of the recording sheet P passing the irradiation area Ar1 is calculated for each microwave irradiation unit 30 of the first block 50, and the reflectance difference Db1 is stored in the EEPROM 28.

Figure 10C:
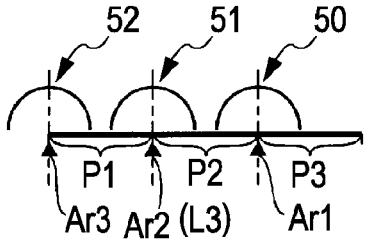

Subsequently, when it is detected that the recording sheet P has been transported to the predetermined position L2 as shown in FIG. 10B (step S390: Yes), the same operations as those of steps S350 to S380 are performed on the first block 50 until the recording sheet P is further transported to a predetermined position L3 shown in FIG. 10C (step S400). That is, the same operations as those of steps S350 to S380 are performed on an irradiating range P2 passing the irradiation area Ar1, subsequent to the irradiating range P1. Moreover, for the second block 51, the following operations of steps S410 to S440 are performed. As shown in FIG. 10C, the predetermined position L3 corresponds to a position at which the leading end of the recording sheet P reaches a microwave irradiation area Ar3 where microwaves are irradiated by the microwave irradiation portion 36 of the third block 52.

As described above, the pairs of the microwave irradiation portions 36 and the microwave incident portions 37 in the first to third blocks 50, 51, and 52 are arranged in three rows in the front-rear direction and in seven rows in the left-right direction. Therefore, the pairs of the microwave irradiation portions 36 and the microwave incident portions 37 of each block, arranged on the same row in the front-rear direction irradiate microwaves to the same portions of the recording sheet P transported in the rear-to-front direction and receive the microwaves reflected from the same portions. That is, each pair of the microwave irradiation portion 36 and the microwave incident portion 37 of the second block 51 is configured to irradiate microwaves to the irradiating portion which has been irradiated with the microwaves by each pair of the microwave irradiation portion 36 and the microwave incident portion 37 of the first block 50 disposed on the same row in the front-rear direction as the pair of the microwave irradiation portion 36 and the microwave incident portion 37 of the second block 51 and which has reflected the microwaves, and to receive the microwaves reflected from the irradiating portion.

In the second block 51 on which the operations of steps S410 to S440 are performed, first, based on the reflectance difference Db1 stored in the EEPROM 28 calculated in step S380, a second irradiation is performed on the irradiating portion positioned at the irradiation area Ar2 (step S410). The second irradiation is an irradiation wherein microwaves of a predetermined irradiation dose (field intensity H3) are irradiated to the irradiating portion positioned at the irradiation area Ar2 based on the reflectance difference Db1 measured in the first block 50. The predetermined irradiation dose (field intensity H3) can be calculated by Formula 2 as follows.

$$H3=H2+k2\times Db1\times H2 \qquad \text{Formula 2}$$

H2: irradiation dose in first irradiation

H3: predetermined irradiation dose k2: positive proportional constant

Db1: reflectance difference

When the reflectance difference satisfies a condition of Da1>0, it can be judged that the irradiating portion is not dried to the predetermined dryness level. Therefore, the irradiating portion in which the reflectance difference satisfies the relation of Da1>0 is irradiated with microwaves of a predetermined irradiation dose (field intensity H3), i.e., a field intensity H3, based on Formula 2, which is higher than the irradiation dose (field intensity H2) of the first irradiation on the basis of the reflectance difference Da1. The proportional constant k2 is used to determine an appropriate range of an increase or a decrease in the irradiation dose of microwaves from the initial irradiation dose H2. On the other hand, when the reflectance difference satisfies a relation of Da1<0, the irradiating portion is dried to the predetermined dryness level or higher. Therefore, no further drying is required, and thus, the irradiation of the microwaves is not performed on this portion.

Next, by referring to FIG. 11B1, the predetermined irradiation dose in step S410 will be described with respect to a pair of the microwave irradiation portion 36 and the microwave incident portion 37 of the second block 51 being disposed on the same row as but on the forward side of the one arbitrary pair of the microwave irradiation portion 36 and the microwave incident portion 37 of the first block 50 described with reference to FIGS. 11A1 and 11A2.

In the range of areas between Pa1 and Pa2 in FIG. 11A2, since the reflectance difference satisfies the relation of Db1>0, the dryness level of the irradiating portion is lower than the predetermined dryness level. Therefore, areas of the irradiating portion corresponding to the range of areas between Pa1 and Pa2 are irradiated with microwaves of a field intensity H3 based on Formula 2, as shown by the range between Qa1 and Qa2, which is greater than the irradiation dose (field intensity H2) of the first irradiation by an amount of k2×Da1×H2, so that the drying of the irradiating portion corresponding to the range of areas between Pa1 and Pa2 is accelerated.

On the other hand, in the range of areas between Pa2 and Pa3 in FIG. 11A2, since the reflectance difference satisfies the relation of Db1<0, the dryness level of the irradiating portion is higher than the predetermined dryness level. Therefore, since the irradiating portion in which the reflectance difference satisfies the relation of Da1<0 is dried to the predetermined dryness level or higher, no further drying is required, and thus, the irradiation of the microwaves is not performed on this portion. Hence, as shown by the range between Qa2 and Qa3, the irradiation of microwaves is not performed.

In the range of areas between Pa3 and Pa4 in FIG. 11A2, since the reflectance difference satisfies the relation of Db1>0, the dryness level of the irradiating portion is lower than the predetermined dryness level. Therefore, areas of the irradiating portion corresponding to the range of areas between Pa3 and Pa4 are irradiated with microwaves of a field intensity H3 based on Formula 2, as shown by the range between Qa3 and Qa4, which is greater than the irradiation dose (field intensity H2) of the first irradiation by an amount of k2×Da1×H2, so that the drying of the irradiating portion corresponding to the range of areas between Pa3 and Pa4 is accelerated.

As described above, although it is not necessary to perform the irradiation of microwaves on the irradiating portion corresponding to the range of areas between Pa2 and Pa3 since the irradiating portion is dried to the predetermined dryness level or higher, the irradiating portion may be irradiated with microwaves of an irradiation dose determined based on Formula 2 within a range in which overheating is prevented. By doing so, it is possible to increase the dryness level of the irradiating portion which is dried to an extent equal to or greater than the target reflectance but not to the perfect extent.

The respective microwave irradiation units 30 of the second block 51 measure the irradiation dose of the microwaves which have been irradiated by the second irradiation (step S410) and reflected from the irradiating portion to be incident to the microwave incident portions 37, and deliver the measured amount to the control portion 21 (step S420). Then, the CPU 25 calculates the reflectance Rb2 of the microwaves at the irradiating portion from the reflected amount of the microwaves incident to the microwave incident portions 37 and the irradiation dose of the microwaves irradiated as the second irradiation from the microwave irradiation portions 36 (step S430). The reflectance Rb2 is calculated for each microwave irradiation unit 30 of the second block 51. Then, a reflectance difference Db2 (=Rb−Rb2), which is a difference between the reflectance Rb2 and the target reflectance Rb, is calculated and stored in the EEPROM 28 (step S440).

Next, by referring to FIG. 11B2, the reflectance Rb2 of the irradiating portion irradiated with microwaves of the irradiation dose shown in FIG. 11B1 will be described with respect to the reflectance Rb2 of the irradiating portion irradiated with the microwaves by the second irradiation.

The irradiating portion corresponding to the range of areas between Pa1 and Pa2 shown in FIG. 11A2 is irradiated with microwaves of the irradiation dose as shown by the range between Qa1 and Qa2 in FIG. 11B1, and the dryness level of the irradiating portion corresponds to the reflectance shown in the range of areas between Pb1 and Pb2 in FIG. 11B2. Since the irradiating portion corresponding to the range of areas between Pa2 and Pa3 shown in FIG. 11A2 has the predetermined dryness level, the irradiation of microwaves is not performed as shown by the range between Qa2 and Qa3 in FIG. 11B1, and thus, the microwaves are not reflected as shown by the range of areas between Pb2 and Pb3 in FIG. 11B2. The irradiating portion corresponding to the range of areas between Pa3 and Pa4 shown in FIG. 11A2 is irradiated with microwaves of the irradiation dose as shown by the range between Qa3 and Qa4 in FIG. 11B1, and the dryness level of the irradiating portion corresponds to the reflectance shown in the range of areas between Pb3 and Pb4 in FIG. 11B2.

When the recording sheet P is transported from the predetermined position L2 to the predetermined position L3 (steps S390 to S450), the above-described operations of steps S400 to S440 are repeated, whereby the reflectance difference Db1 which is a difference between the reflectance Rb1 and the target reflectance Rb is calculated for each microwave irradiation unit 30 of the first block 50, and the reflectance difference Db1 is stored in the EEPROM 28 (step S400). Moreover, the reflectance difference Db2 (=Rb−Rb2) which is a difference between the reflectance Rb2 and the target reflectance Rb is calculated for each microwave irradiation unit 30 of the second block 51, and the reflectance difference Db2 is stored in the EEPROM 28 (step S440).

That is, the same operations (step S400) as those of steps S340 to S380 are performed on the irradiating range P2 passing the irradiation area Ar1, which is subsequent to the irradiating range P1, and the operations of steps S410 to S440 are performed on the irradiating range P1.

Figure 10D:
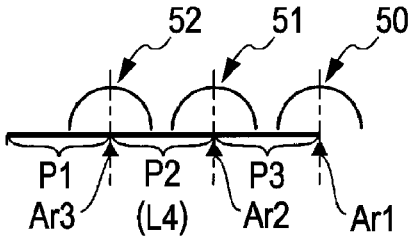

Subsequently, when it is detected that the recording sheet P has been transported to the predetermined position L3 as shown in FIG. 10C (step S450: Yes), the same operations as those of steps S350 to S380 are performed on the first block 50 until the recording sheet P is further transported to a predetermined position L4 shown in FIG. 10D (step S460). That is, the same operations (step S460) as those of steps S340 to S380 are performed on the irradiating range P3 passing the irradiation area Ar1, subsequent to the irradiating range P2. As shown in FIG. 10D, the predetermined position L4 corresponds to a position at which the trailing end of the recording sheet P reaches the irradiation area Ar1 of the first block 50.

Regarding the second block 51, the same operations as those of steps S410 to S440 are performed based on the reflectance difference Db1 calculated as a result of the operation of step S400 (step S470). Specifically, the operations of steps S410 to S440 are performed on the irradiating range P2 passing the irradiation area Ar2, subsequent to the irradiating range P1.

The following operations of step S480 are performed on the third block 52.

First, based on the reflectance Db2 stored in the EEPROM 28 calculated in step S440, a third irradiation is performed on the irradiating portion positioned at the irradiation area Ar3 (step S480). The third irradiation is an irradiation wherein microwaves of a predetermined irradiation dose (field intensity H4) are irradiated to the irradiating portion positioned at the irradiation area Ar3 based on the reflectance difference Db2 measured in the second block 51. The predetermined irradiation dose (field intensity H4) can be calculated by Formula 3 as follows.

$$H4=H3+k3\times Db2\times H3 \qquad \text{Formula 3}$$

H3: irradiation dose in second irradiation

H4: predetermined irradiation dose k3: positive proportional constant

Db2: reflectance difference

The above-described operations of steps S460 to S480 are repeated until the recording sheet P is transported to the predetermined position L4 shown in FIG. 10D.

Next, by referring to FIG. 11C1, the predetermined irradiation dose in step S480 will be described with respect to a pair of the microwave irradiation portion 36 and the microwave incident portion 37 of the third block 52 being disposed on the same row as the one arbitrary pair of the microwave irradiation portion 36 and the microwave incident portion 37 of the second block 51 described with reference to FIGS. 11B1 and 11B2.

Since the irradiating portion corresponding the ranges of areas from Pb1 to Pb2 and from Pb2 to Pb3 is dried to the predetermined dryness level or higher, the irradiating portion is irradiated with microwaves of a field intensity H4, as shown by the range between Qb1 and Qb3, which is smaller than the irradiation dose (field intensity H3) of the second irradiation by an amount of k3×Da2×H3. Moreover, the irradiating portion where Da1=0 is irradiated with microwaves of the field intensity H3.

In the range of areas between Pb1 and Pb2 in FIG. 11B2, since the reflectance is equal to or greater than the target reflectance Rb, i.e., a reflectance difference relation of Db2<0 is satisfied, the dryness level is equal to or higher than the predetermined dryness level. Therefore, since the irradiating portion corresponding to the range of areas between Pb1 and Pb2 does not require further drying, the irradiation of microwaves is not performed as shown by the range between Qb1 and Qb2.

In the range of areas between Pb2 and Pb3 in FIG. 11B2, the dryness level has already reached the predetermined dryness level during the first irradiation with respect to the first block 50. Therefore, the reflectance difference relation of Db2<0 is satisfied, and thus, the irradiation of microwaves is not performed on the irradiating portion corresponding to the range of areas between Pb2 and Pb3, as shown by the range between Qb2 and Qb3.

On the other hand, since the irradiating portion corresponding to the range of areas between Pb3 and Pb4 in FIG. 11B2 is not dried to the predetermined dryness level, the irradiating portion is irradiated with microwaves of the field intensity H4, based on Formula 3, as shown by the range between Qb3 and Qb4 in FIG. 11C1, which is greater than the irradiation dose (field intensity H3) of the second irradiation by an amount of k3×Da2×H3, so that the drying of the irradiating portion corresponding to the range of areas between Pb3 and Pb4 is accelerated.

Moreover, the dryness level of the irradiating portion corresponding to the range of areas between Pb3 and Pb4 in FIG. 11B2 reaches the predetermined dryness level as indicated by Pc3 and Pc4 in FIG. 11C2 by the irradiation of microwaves as shown by the range between Qb3 and Qb4 in FIG. 11*c*, and thus, the reflectance Rb3 reaches the target reflectance Rb. On the other hand, since the dryness level of the irradiating portion corresponding to the range of areas between Pb1 and Pb2 shown in FIG. 11B2 has already reached the predetermined dryness level, the irradiation of microwaves is not performed thereon as shown by the range between Qb1 and Qb2 in FIG.

11C1, and thus, the microwaves are not reflected therefrom as indicated by Pc1 and Pc2 in FIG. 11C2. Moreover, since the dryness level of the irradiating portion corresponding to the range of areas between Pb2 and Pb3 shown in FIG. 11B2 has already reached the predetermined dryness level, the irradiation of microwaves is not performed thereon as shown by the range between Qb2 and Qb3 in FIG. 11C1, and thus, the microwaves are not reflected therefrom as indicated by Pc2 and Pc3 in FIG. 11C2. Therefore, the predetermined dryness level can be obtained over the entire range of the irradiating range P1.

When the recording sheet P is transported from the predetermined position L3 to the predetermined position L4 (steps S450 to S490), the above-described operations of steps S460 to S480 are repeated.

The reflectance difference Db1 which is a difference between the reflectance Rb1 and the target reflectance Rb is calculated for each microwave irradiation unit 30 of the first block 50, and the reflectance difference Db1 is stored in the EEPROM 28 (step S460). Moreover, the reflectance difference Db2 (=Rb−Rb2) which is a difference between the reflectance Rb2 and the target reflectance Rb is calculated for each microwave irradiation unit 30 of the second block 51, and the reflectance difference Db2 is stored in the EEPROM 28 (step S470).

Figure 10E:
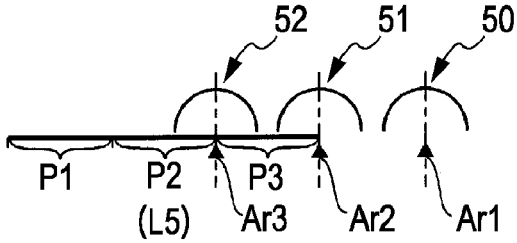

Subsequently, when it is detected that the recording sheet P has been transported to the predetermined position L4 as shown in FIG. 10D (step S490: Yes), the same operations as those of steps S410 to S440 are performed on the irradiating range P3 of the second block 51 based on the reflectance difference Db1 calculated as a result of the operation of step S460 until the recording sheet P is further transported to a predetermined position L5 shown in FIG. 10E (step S500). As shown in FIG. 10E, the predetermined position L5 corresponds to a position at which the trailing end of the recording sheet P reaches the microwave irradiation area Ar2 where microwaves are irradiated by the microwave irradiation portion 36 of the second block 51.

Regarding the third block 52, the same operation as that of step S480 is performed on the irradiating range P2 based on the reflectance difference Db1 calculated as a result of the operation of step S470 (step S510). Moreover, since the recording sheet P has already passed the irradiation area Ar1, the first block 50 does not perform the irradiation of microwaves.

The above-described operations of steps S500 to S510 are repeated until the recording sheet P is transported to the predetermined position L5 shown in FIG. 10E.

Figure 10F:
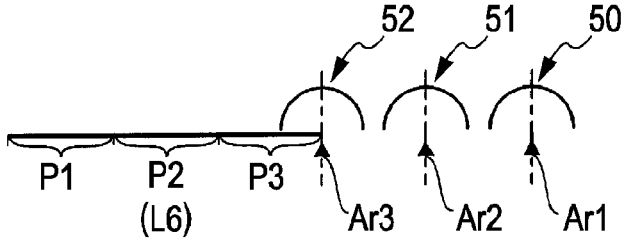

Subsequently, when it is detected that the recording sheet P has been transported to the predetermined position L5 as shown in FIG. 10E (step S520: Yes), the same operation as that of step S480 is performed on the irradiating range P3 of the third block 52 based on the reflectance difference Db2 calculated as a result of the operation of step S500 until the recording sheet P is further transported to a predetermined position L6 shown in FIG. 10F (step S530). As shown in FIG. 10F, the predetermined position L6 corresponds to a position at which the trailing end of the recording sheet P reaches the microwave irradiation area Ar3 where microwaves are irradiated by the microwave irradiation portion 36 of the third block 52 and at which the heating of the recording sheet P stops.

Since the recording sheet P has already passed the irradiation area Ar1 and the irradiation area Ar2, the first block 50 and the second block 51 do not perform the irradiation of microwaves. The operation of step S530 is repeated until the recording sheet P is transported to the predetermined position L6 shown in FIG. 10F (step S540: Yes), and then, the recording sheet P is discharged (step S550).

In this manner, by irradiating microwaves of an irradiation dose corresponding to the dryness level of the recorded portion passing through the first to third blocks 50, 51, and 52 while transporting the recording sheet P, the dryness level of the irradiating portion can be gradually changed to approach the predetermined dryness level when the irradiating portion passes through the irradiation areas Ar1, Ar2, and Ar3 of the first to third blocks 50, 51, and 52. Owing to such a configuration, it is possible to suppress the drying stress generated when the recording sheet P is abruptly dried, thus preventing deformation such as rippling or curling of the recording sheet P. Moreover, by irradiating the irradiating portion with the microwaves of the irradiation dose necessary for changing the dryness level of the irradiating portion to the predetermined dryness level in several times, it is possible to heat the irradiating portion at high temperature at which the irradiating portion is prevented from catching fire or being deteriorated. Furthermore, since the transport of the recording sheet P is continued, it is possible to shorten the time in which the recording sheet P passes through the heating portion 2. Particularly, when a line recording head is used as the recording head 4, the recording operation of the recording portion 1 can be performed in a short period of time, and the transport speed of the recording sheet P can be increased. Therefore, by allowing the heating portion 2 to heat the recording sheet P without stopping the transport of the recording sheet P, it is possible to increase an overall processing speed of the printer 300 including a recording speed and a heating speed.

Although the irradiation dose of the microwaves is described as being the field intensity when describing the construction of the printer 300, the irradiation dose is an amount which is determined by the transport speed of the recording sheet P and the field intensity. However, the reflectance difference Db1 and Db2 used for determining the irradiation dose of the microwaves during the second irradiation (step S410) and the third irradiation (step S480) is determined on the basis of the same target reflectance Rb. Therefore, the irradiating portion in which the reflectance differences Db1 and Db2 are greater than 0 (Db1>0, Db2>0) (i.e., the dryness level is lower than the predetermined dryness level) is irradiated with microwaves of an irradiation dose which is greater than the previous irradiation dose. However, the dryness level of the irradiating portion increases as the number of irradiations of the microwaves increases. Therefore, there may be a case where it is desirable to decrease the irradiation dose as the number of irradiations increases. In this regard, by setting the target reflectance at the time of performing the second irradiation to an appropriate value lower than the target reflectance at the time of performing the first irradiation, when the third irradiation is performed, the irradiating portion in which the reflectance difference satisfies the relation of Db2>0 can be irradiated with microwaves of an irradiation dose lower than the irradiation dose of the previous irradiation (second irradiation). The target reflectance at the time of performing the second irradiation can be predetermined through experiments depending on the type of a recording sheet P and ink used.

When it is determined that when the recording sheet P has been moved to the predetermined position L6, the dryness level of the recording sheet P is not changed to the predetermined dryness level, such determination results may be output and displayed. When such results are displayed, since it is the case where the recording sheet P is not yet dried to the predetermined dryness level, it may be inappropriate to stack a later-recorded recording sheet P on the recording sheet P.

Therefore, when such results are displayed, it may be desirable to stop the operation of the printer 300. Moreover, although the printer 300 is configured to move the recording sheet P with respect to the first to third blocks 50, 51, and 52, a configuration may be used in which the first to third blocks 50, 51, and 52 are moved with respect to the recording sheet P. Furthermore, although in the printer 300, the timings for the respective blocks 50, 51, and 52 to start irradiation of microwaves are set to correspond to the respective time points at which the leading end of the recording sheet P reaches the irradiation areas Ar1, Ar2, and Ar3 located near the center of the microwave absorption plates 53, the timings may be set to correspond to time points at which the leading end of the recording sheet P almost reaches the respective blocks 50, 51, and 52.

In the embodiments described above, the necessary irradiation dose or the predetermined irradiation dose is calculated based on the reflectance of microwaves reflected from the recording sheet P after being irradiated from the microwave irradiation portion 36 or the reflectance difference which is a difference between the reflectance and the predetermined reflectance (target reflectance). However, the necessary irradiation dose or the predetermined irradiation dose may be calculated by measuring the dryness level from the reflected amount of the microwaves without the necessity of calculating the reflectance.

Furthermore, instead of measuring the dryness level based on the microwaves reflected from the recording sheet P after being irradiated from the microwave irradiation portion 36, a temperature of the recording sheet P measured by means of an infrared sensor to thereby determine the dryness level based on the temperature.

The microwaves have a characteristic that they are also easily absorbed in carbon as well as moisture as described above. When microwaves are irradiated to an irradiating portion having a recorded portion that is recorded with ink having a high carbon content, such as black ink, there is a fear that the irradiating portion is quickly heated compared with a moisture-only case, and thus, the recording sheet P is likely to catch fire or be deteriorated. However, as described in the respective embodiments, by measuring the absorbed amount (reflected amount) of the microwaves at the recorded portion and controlling the irradiation dose of the microwaves based on the measurement results, it is possible to prevent the recording sheet P from catching fire or being deteriorated.

The entire disclosure of Japanese Patent Application No: 2007-331599, filed Dec. 25, 2007 is expressly incorporated by reference herein.

What is claimed is:

1. A recording apparatus comprising:

a recording unit that ejects liquid so that the liquid is recorded on a recording medium;

a transporting unit that transports the recording medium;

a plurality of microwave irradiation units that irradiate microwaves to the recording medium, the plurality of microwave irradiation units being positioned above the transporting unit at a position which is downstream from the recording unit in a transport direction;

a plurality of microwave reception units that receive the microwaves reflected from the recording medium, each microwave reception unit corresponding to one of the plurality of microwave irradiation units; and a microwave irradiation control unit that determines a dryness level of a plurality of portions of the recording medium based on a reception level by the plurality of microwave reception units corresponding to the plurality of portions of the recording medium, calculating a reflectance incident to each microwave reception unit, comparing the calculated reflectance to a predetermined dryness level, calculating a necessary irradiation dose to achieve the predetermined dryness level based on the difference between the measured reflectance and the predetermined dryness level, and controlling an irradiation dose or an irradiation intensity of the microwaves irradiated by each of the microwave irradiation units by causing the microwave irradiation units to each irradiate the necessary irradiation dose toward the corresponding portion of the recording medium.

2. The recording apparatus according to claim 1, wherein each microwave irradiation unit irradiates the microwaves to the corresponding portion of the recording medium, wherein the microwave reception unit receives the microwaves reflected from the corresponding portion, and wherein the microwave irradiation control unit determines the dryness level of the recording medium at the plurality of areas based on the reception level by the microwave reception unit and controls the irradiation dose or the irradiation intensity of the microwaves irradiated by the microwave irradiation.

3. The recording apparatus according to claim 2, wherein the microwave irradiation control unit controls the irradiation dose or the irradiation intensity of the microwaves with respect to a first portion of the plurality of portions based on the dryness level of the recording medium at a second portion located upstream from the first portion in the direction for transporting the recording medium.

4. A recording method comprising:

a recording step of ejecting liquid so that the liquid is recorded on a recording medium;

a transporting step of transporting the recording medium using a transporting unit;

a microwave irradiation step of irradiating microwaves to the recording medium using a plurality of microwave irradiation units that irradiate microwaves to the recording medium and which are positioned above the transporting unit at a position which is downstream from the recording unit in a transport direction;

a microwave reception step of receiving the microwaves reflected from the recording medium using a plurality of microwave reception units which individually correspond to one of the plurality of microwave irradiation units; and a microwave irradiation control step of determining a dryness level of a plurality of portions of the recording medium based on a reception level by the plurality of microwave reception units in the microwave reception step, determining the dryness level including calculating a reflectance incident to each microwave reception unit, comparing the calculated reflectance to a predetermined dryness level, calculating a necessary irradiation dose to achieve the predetermined dryness level based on the difference between the measured reflectance and the predetermined dryness level, and irradiating with the necessary irradiation dose and controlling an irradiation dose or an irradiation intensity of the microwaves irradiated by the each of the microwave irradiation units in accordance with the necessary irradiation dose of the corresponding portion of the recording medium.

* * * * *